US006225969B1

(12) United States Patent
Ishii

(10) Patent No.: US 6,225,969 B1
(45) Date of Patent: May 1, 2001

(54) DRIVER OF LIQUID CRYSTAL PANEL, LIQUID CRYSTAL DEVICE, AND ELECTRONIC EQUIPMENT

(75) Inventor: Kenya Ishii, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/101,270

(22) PCT Filed: Nov. 10, 1997

(86) PCT No.: PCT/JP97/04092

§ 371 Date: Jul. 8, 1998

§ 102(e) Date: Jul. 8, 1998

(87) PCT Pub. No.: WO98/21707

PCT Pub. Date: May 22, 1998

(30) Foreign Application Priority Data

Nov. 8, 1996 (JP) ..... 8-296546

(51) Int. Cl.[7] ..... G09G 3/36
(52) U.S. Cl. ..... 345/100; 345/98; 345/198
(58) Field of Search ..... 345/98–100, 197, 345/198, 205, 206

(56) References Cited

U.S. PATENT DOCUMENTS 4,795,239 * 1/1989 Yamashita et al. ..... 345/87
5,357,290 * 10/1994 Horibe ..... 348/792
5,442,372 * 8/1995 Shiki ..... 345/98
5,625,376 * 4/1997 Maekawa ..... 345/132

FOREIGN PATENT DOCUMENTS 0 607 778 A1 7/1994 (EP) .
61-56327 3/1986 (JP) .
4-165329 6/1992 (JP) .
6-202595 7/1994 (JP) .
9-154086 10/1997 (JP) .

* cited by examiner

*Primary Examiner*—Richard Hjerpe
*Assistant Examiner*—Alexander Eisen
(74) *Attorney, Agent, or Firm*—Oliff & Berridge, PLC

(57) ABSTRACT

A driver for driving a liquid crystal panel that includes a pair of substrates, a liquid crystal sandwiched between the substrates, a plurality of signal lines (31) which are arranged in a first given direction on a substrate and to which an image signal is supplied, a plurality of scanning lines (32) which are arranged in a second direction and to which a scan signal is supplied sequentially, and a plurality of pixels arranged in the form of a matrix on the surface of a substrate opposed to the liquid crystal, and driven with the image signal and scan signal supplied over the plurality of signal lines and plurality of scanning lines comprises: an image signal supply unit (101 to 104) including a first-direction shift register that has a plurality of stages **(1*a*) and supplying the image signal sequentially to the plurality of signal lines in a first direction according to a transfer signal sequentially generated by the first-direction shift register, and a scan signal supply unit including a second-direction shift register (2) that has a plurality of stages and supplying the scan signal sequentially to the plurality of scanning lines in a second direction according to a transfer signal sequentially generated by the second-direction shift register. At least one of the first-direction and second-direction shift registers includes a transfer start control unit (11)** for selectively allowing at least two predetermined stages capable of starting transfer among the plurality of stages to start generating a transfer signal.

6 Claims, 18 Drawing Sheets

DRIVER OF LIQUID CRYSTAL PANEL, LIQUID CRYSTAL DEVICE, AND ELECTRONIC EQUIPMENT

BACKGROUND OF THE INVENTION

1. Field of the Invention

The present invention relates to a technical field involving a driver of a liquid crystal panel of a matrix driving type which adopts transistor driving, metal-insulator-metal (MIM) driving, or the like, and a liquid crystal device and electronic equipment using this driver. More particularly, this invention is concerned with a technical field involving a driver for driving a liquid crystal panel so that images of different aspect ratios can be displayed according to the type of an image signal, a liquid crystal device and electronic equipment using this driver.

2. Description of Related Art

In recent years, liquid crystal devices have been requested to cope with a plurality of different specifications for display in compliance with the demands from markets for displaying a TV picture in a wider screen and for sharing the same specifications for display with computers or the like. However, a dot-matrix type liquid crystal device in accordance with a related art has difficulty in handling a non-image display area in which no picture is displayed and which is produced when corresponding a plurality of specifications for display having different aspect ratios. For example, when an attempt is made to display a screen of an aspect ratio 4:3, which conforms to an existing National Television System Committee (NTSC) standard and a Phase Alternation Line (PAL) standard, being involved in a dot-matrix type liquid crystal device offering a screen of an aspect ratio 16:9 which conforms to a recent high-definition TV standard and an NTSC standard on a wide screen, non-image display areas are created on the right and left sides of the image display field. The non-image display areas are normally blackened. However, when an ordinary shift register is driven for blackening, it is impossible to horizontally scan all pixel electrodes included in the non-image display areas and display them within each horizontal retrace period. Consequently, long adopted is the technique of adjusting the line frequency for a horizontal scan using an external storage device such as a line memory, or the technique of driving a shift register only in the non-image display areas at a high frequency that is 1.5 times to twice higher than the frequency driven in the image display area.

In contrast, when an attempt is made to display a screen with an aspect ratio 16:9 based on the high-definition TV standard or the like in a dot-matrix type liquid crystal device offering a screen with an aspect ratio 4:3 based on the existing NTSC standard or the like, non-image display areas are created above and below the image display area. The non-image display areas are normally blackened. Even in this case, long adopted is the technique of adjusting a line frequency for vertical scanning using an external storage device, or the technique of driving a shift register only in the non-image display areas at a frequency which is higher than the frequency driven in the image display area.

Moreover, Japanese Unexamined Patent Publication No. 9-154086 has disclosed a display device including a device for controlling the horizontal scan so that a signal sent from a sub-video signal processor can be displayed in right and left non-image display areas at the same time. According to this art, since pixels constituting the right and left non-image display areas are scanned at the same time, the time required for scanning the areas is halved.

However, when the foregoing system of driving a shift register, at a frequency higher than the frequency at which the shift register is driven in an image display area is adopted in order to blacken non-image display areas, the shift register must exhibit excellent characteristics. Moreover, there is a problem that since the time required for selecting any pixels in the non-image display areas is shortened, a sufficient contrast ratio cannot be attained. In addition, since the driving frequency becomes high, the power consumption increases. On the other hand, the foregoing system using an external storage device such as a line memory has a problem that not only an increase in cost is invited, but also the design of peripheral circuits or the operational control gets more complex.

According to the art disclosed in Japanese Unexamined Patent Publication No. 9-154086, in order that the pixels constituting the right and left non-image display areas are scanned concurrently, complex circuits such as a sub-video signal processor and video signal switching device must be incorporated in the drive circuit. This makes the configuration of a display device or a control complex. Furthermore, for blackening the right and left non-image display areas, the scan time that is approximately one-half of the scan time required for scanning the pixels in the right and left non-image display areas separately is required.

SUMMARY OF THE INVENTION

A technical subject of the present invention is to provide a driver of a liquid crystal panel making it possible to properly blacken non-image display areas using a relatively simple configuration and to display images of various aspect ratios, and a liquid crystal device and electronic equipment including the driver.

For overcoming the aforesaid technical subject, a driver of a liquid crystal panel in accordance with the present invention is a driver for driving a liquid crystal panel that comprises a pair of substrates, a liquid crystal sandwiched between the substrates, a plurality of signal lines which are arranged in a given first direction on the substrate and to which an image signal is supplied, a plurality of scanning lines which are arranged in a second direction orthogonal to the first direction on the substrate and to which a scan signal is supplied sequentially, and a plurality of pixels arranged in the form of a matrix on the liquid crystal side-surface of the substrate, and driven with the image signal and scan signal supplied by the plurality of signal lines and the plurality of scanning lines respectively. The driver comprises an image signal supply unit that includes a first-direction shift register having a plurality of stages, which supplies the image signal sequentially to the plurality of signal lines in a first direction in response to a transfer signal sent sequentially from the first-direction shift register, and a scan signal supply unit that includes a second-direction shift register having a plurality of stages, which supplies the scan signal sequentially to the plurality of scanning lines in a second direction in response to a transfer signal sent sequentially from the second-direction shift register. At least one of the first-direction and second-direction shift registers includes a transfer start control unit for selectively allowing at least two predetermined stages capable of starting transfer among the plurality of stages to start generating a transfer signal.

According to the present invention, there is provided a driver of a liquid crystal panel in which an image signal supply unit supplies an image signal sequentially to a plurality of signal lines in a first direction in response to a transfer signal sent sequentially from a first-direction shift register. Meanwhile, a scan signal supply unit supplies a scan signal sequentially to a plurality of scanning lines in a second direction in response to a transfer signal sent sequentially from a second-direction shift register. As a result, for example, a horizontal scan is carried out according to the transfer signal sent from the first-direction shift register, and a vertical scan is carried out according to the transfer signal sent from the second-direction shift register. Herein, a transfer start control unit included in at least one of the first-direction and second-direction shift registers selectively allows at least two stages capable of starting transfer to start generating a transfer signal. This makes it possible to start, for example, a horizontal scan or a vertical scan at an intermediate position corresponding to a stage capable of starting transfer in at least one of the first and second directions associated with the first-direction and second-direction shift registers. It is therefore possible to display an image in an area contributing to image display, without driving stages preceding the stages capable of starting transfer among the plurality of stages of the first-direction and second-direction shift registers (for example, stages corresponding to the leftmost area or stages corresponding to the uppermost area), that is, stages corresponding to areas not contributing to image display. When the aspect ratio of an image to be displayed is inconsistent with the certain aspect ratio of a screen offered by a liquid crystal panel, an effective image may not be displayed in the uppermost and lowermost areas or the rightmost and leftmost areas. Even in this case, unnecessary scan time for scanning the areas not contributing to image display (non-image display areas) can be eliminated. This obviates the necessity of driving the first-direction and second-direction shift registers at a frequency equal to or higher than a frequency at which the shift registers are driven for scanning the image display area. As a result, the overall circuitry gets simplified and control gets easier. Moreover, a large margin can be ensured for the characteristics of devices constituting a shift register or for power consumption.

According to one aspect of the present invention described above, there is provided a driver of a liquid crystal panel in which the first-direction and second-direction shift registers each include a plurality of transfer signal generation circuits for generating a transfer signal. The transfer start control unit includes a first logic circuit that is connected on a transfer start signal line to which a transfer start signal is supplied and that supplies the transfer start signal to a transfer signal generation circuit on a stage capable of starting transfer and thus allows the transfer signal generation circuit to start generating the transfer signal.

According to this aspect, the first-direction and second-direction shift registers each include a transfer signal generation circuit for generating a transfer signal, for example, a flip-flop. When the first logic circuit, for example, an OR circuit, included in the transfer start control unit applies a transfer start signal to a transfer signal generation circuit on a stage capable of starting transfer, the transfer signal generation circuit starts generating a transfer signal. Thus, it is possible to display an image in an area contributing to image display without driving the transfer signal generation circuits preceding the transfer signal generation circuit on the stages capable of starting transfer.

According to another aspect of the present invention, there is provided a driver of a liquid crystal panel in which at least one of the first-direction and second-direction shift registers includes a transfer stop control unit for selectively allowing at least two predetermined stages, capable of stopping transfer among the plurality of stages, to stop transferring a transfer signal.

According to this aspect, the transfer stop control unit selectively allows at least two stages capable of stopping transfer to stop transferring a transfer signal. For example, horizontal scan or vertical scan can be stopped at an intermediate position corresponding to a stage capable of stopping transfer in at least one of a first and second directions. It is therefore possible to carry out image display in an area contributing to image display without driving stages succeeding the stage capable of stopping transfer among the plurality of stages of first-direction and second-direction shift registers (for example, stages corresponding to the rightmost area and lowermost area), that is, stages corresponding to areas not contributing to image display.

According to this aspect, the first-direction and second-direction shift registers each include a plurality of transfer signal generation circuits for generating a transfer signal. The transfer stop control unit may include a second logic circuit that is connected to a transfer stop signal line to which a transfer stop signal is supplied and that stops a transfer signal sent from a transfer signal generation circuit on a stage capable of stopping transfer according to the transfer stop signal.

Owing to this configuration, the second logic circuit, for example, an AND circuit included in the transfer stop control unit stops a transfer signal sent from a transfer signal generation circuit, for example, a flip-flop corresponding to a stage capable of stopping transfer. Consequently, an image can be displayed in an area contributing to image display without the necessity of driving transfer signal generation circuits succeeding the transfer signal generation circuit corresponding to the stage capable of stopping transfer.

According to another aspect of the present invention described above, there is provided a driver of a liquid crystal panel in which at least one of the first-direction and second-direction shift registers includes a detector for detecting a termination of scan effected with a transfer signal on a given stage. The driver of a liquid crystal panel further comprises a voltage application device for applying a given voltage to pixels constituting non-image display areas outside an image display area defined by an image signal at the same time when a termination of scan is detected.

According to this aspect, when the detector detects a termination of scan effected with a transfer signal on a given stage, the voltage application device applies a given voltage to the pixels corresponding to the non-image display areas at the same time when a termination of scan is detected. The non-image display areas therefore can be, for example, blackened without being scanned.

According to this aspect, the voltage application device may reverse the polarity of the given voltage to be applied to the liquid crystal portions of the pixels according to the image signal at intervals of a given period.

In this case, the liquid crystal portions of the non-image display areas can be driven while the polarity of an applied voltage is reversed for each vertical scan period such as a field or frame or for each scanning line (row). Deterioration of the liquid crystal portions of the non-image display areas derived from application of a DC voltage can be prevented. In particular, flickers can be prevented by reversing the polarity of the applied voltage for each scanning line.

According to another aspect of the present invention, there is provided a driver of a liquid crystal panel in which the image signal supply unit includes a switching device that when driven to conduction according to a transfer signal generated by the first-direction shift register, supplies the externally-input image signal sequentially to the plurality of signal lines.

According to this aspect, a switching device, for example, a thin-film transistor (TFT) to be driven to conduction according to a transfer signal generated by the first-direction shift register, is used to supply an externally-input image signal sequentially to the plurality of signal lines. The switching device is used to sample the externally-input image signal, and a transfer signal generated by the first-direction shift register is used as a driving signal used to drive a sampling circuit, whereby scan in a first direction can be achieved.

According to another aspect of the present invention, there is provided a driver of a liquid crystal panel in which at least one of the first-direction and second-direction shift registers includes a selector for selecting one of the stages capable of starting transfer according to the size of a display image indicated by the image signal.

According to this aspect, the selector selects one of the stages capable of starting transfer according to the size of a display image indicated by an image signal for, for example, NTSC-conformable display, NTSC on wide screen-conformable display, or PAL-conformable display. A scan can be automatically started at a position suitable for the type of an externally-input image signal.

According to an aspect of the present invention in which the transfer stop control unit is included, at least one of the first-direction and second-direction shift registers may include a selector for selecting one of the stages capable of stopping transfer according to the size of a display image indicated by the image signal.

According to this aspect, the selector selects one of the stages capable of stopping transfer according to the size of a display image indicated by an image signal for, for example, a NTSC-conformable display, a NTSC on wide screen-conformable display, or a PAL-conformable display. Consequently, a scan can be stopped at a position suitable for the type of an externally-input image signal. When both the selector for selecting one of the stages capable of starting transfer and the selector for selecting one of the stages capable of stopping transfer are included, needless to say, a scan can be achieved automatically in a manner most suitable for the type of an externally-input image signal.

According to another aspect of the present invention, there is provided a driver of a liquid crystal panel in which the image signal supply unit and scan signal supply unit are each realized with an integrated circuit that is arranged on a first substrate in the perimeter of an image display area defined by the plurality of pixels.

According to this aspect, the image signal supply unit and scan signal supply unit, each realized with an integrated circuit arranged on the first substrate in the perimeter of the image display area, preferably scan the image display area two-dimensionally.

According to the present invention, there is provided a liquid crystal device in which the driver of a liquid crystal panel in accordance with the present invention and the liquid crystal panel are included for overcoming the aforesaid technical subject.

According to the present invention, since the liquid crystal device includes the aforesaid driver of a liquid crystal panel in accordance with the present invention and the liquid crystal panel, while non-image display areas can be blackened properly using a relatively simple configuration, images of various aspect ratios can be displayed.

Furthermore, the electronic equipment in accordance with the present invention is characterized in that the aforesaid liquid crystal device in accordance with the present invention is included for overcoming the aforesaid technical subject.

According to the present invention, there is provided electronic equipment in which, since a liquid crystal device in accordance with the present invention is included, various electronic equipment including a liquid crystal projector, personal computer, and pager which can display images of various aspect ratios in a screen using a relatively simple configuration can be realized.

DETAILED DESCRIPTION OF THE PREFERRED EMBODIMENTS

The best mode for carrying out the present invention will be described in relation to preferred embodiments on the basis of the drawings.

Figure 1:
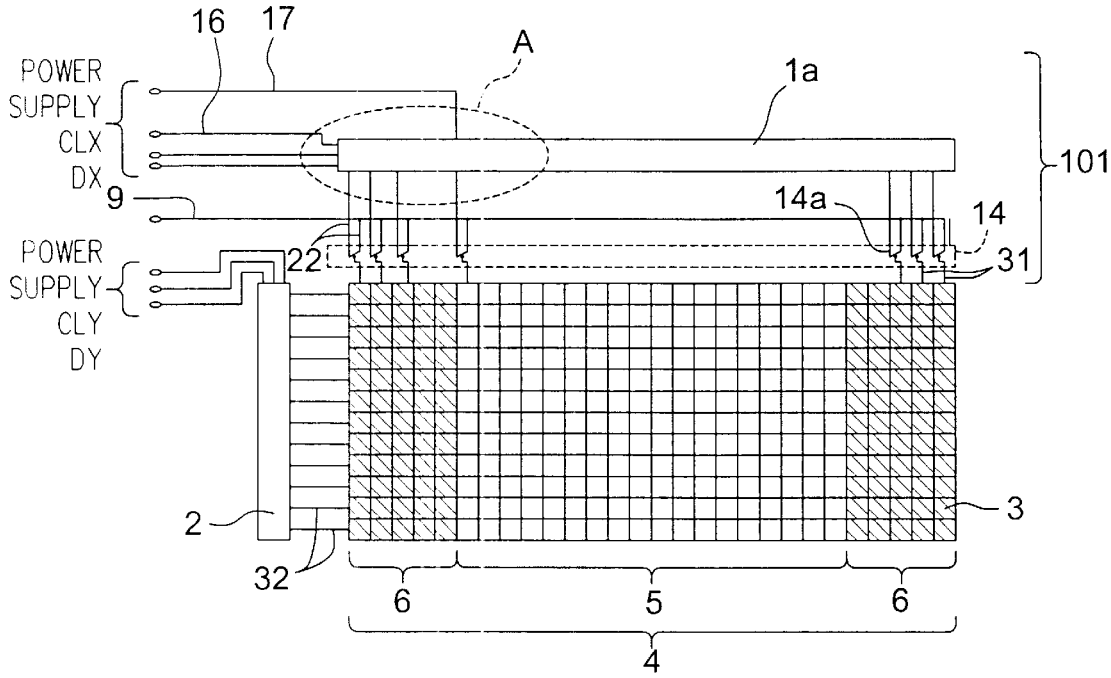
FIG. 1 is a circuit block diagram showing the first embodiment in the best mode for carrying out the present invention.

To begin with, the first embodiment will be described with reference to FIGS. 1 and 2. FIG. 1 is a circuit block diagram showing a liquid crystal device in accordance with the first embodiment, and FIG. 2 is an enlarged view of portion A of FIG. 1.

Referring to FIG. 1, a liquid crystal device comprises an X shift register (X drive circuit) 1*a*, a Y shift register (Y drive circuit) 2, and a pixel matrix 3. The liquid crystal device further comprises a sampling circuit 14. The X shift register 1*a*, sampling circuit 14, and various lines (9, 16, 17, 22) to be described later constitute an image signal supply unit 101.

Figure 2:
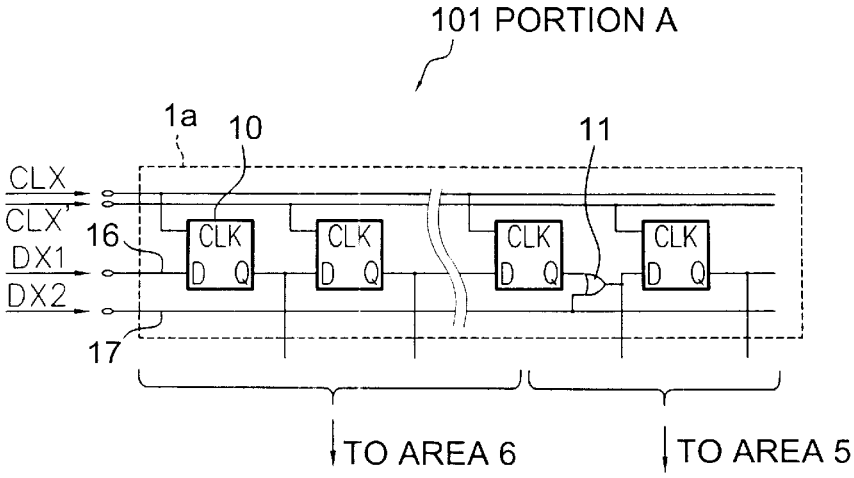
FIG. 2 is an enlarged circuit block diagram of portion A of FIG. 1.

The X shift register 1*a* has, as shown in FIG. 2, a series of flip-flops 10 arranged in series with one another in an X direction for the purpose of horizontal scan. More particularly, when a horizontal scan start signal DX1 is supplied to the X shift register 1*a* through the line 16, the leftmost flip-flop 10, which is illustrated leftmost in the drawing, starts generating a transfer signal based on a clock signal CLX (and its reverse clock signal CLX') that is a reference clock signal for the X shift register. When the first stage outputs the transfer signal, the transfer signal is transferred to a flip-flop 10 of the next stage. This causes the next-stage flip-flop 10 to generate a transfer signal on the basis of the clock signal CLX. When this operation is repeated, a transfer signal is output sequentially from each stage of the X shift register 1*a* and transferred to a subsequent stage.

In FIG. 1, the Y shift register 2 has a series of flip-flops arranged in series with one another in a Y direction for the purpose of vertical scan. More particularly, when a vertical scan start signal DY is supplied to the Y shift register 2, an uppermost flip-flop starts generating a transfer signal based on a clock signal CLY (and its reverse clock signal CLY') that is a reference clock signal for the Y shift register. When the first stage outputs a transfer signal to an associated scanning line 32, the transfer signal is transferred to a flip-flop of the next stage. This causes the next-stage flip-flop to generate a transfer signal on the basis of the clock signal CLY. When this operation is repeated, a transfer signal is output sequentially to each scanning line 32 as a scan signal from each stage of the Y shift register 2, and transferred to a subsequent stage at the same time.

The sampling circuit 14 includes the thin-film transistors (TFTs) 14*a* at every signal line 31. An input image signal line 9 is linked to the source electrodes of the TFTs 14*a*. The sampling circuit driving signal lines 22, to which a transfer signal, output sequentially from each stage of the X shift register 1*a*, is supplied as a sampling circuit driving signal, are linked to gates of the TFTs 14*a*. When an image signal is input through the input image signal line 9 to the sampling circuit 14, the sampling circuit 14 samples the signal. When a sampling circuit driving signal is input from the X shift register 1*a* to the sampling circuit 14 through a sampling circuit driving signal line 22, a sampled image signal is applied sequentially to each signal line 31.

For brevity's sake, the above description has proceeded on the assumption that the X shift register 1*a* and sampling circuit 14 supply an image signal line-sequentially (that is, one to each signal line 31). Alternatively, multiphase image signals may be applied to signal lines 31 through a plurality of input image signal lines 9. In other words, a method in which a plurality of TFTs 14*a* connected to a plurality of adjacent signal lines 31 are selected simultaneously and multiphase signals are transferred sequentially to each group of a plurality of signal lines 31 may be adopted. The number of signal lines 31 to be selected simultaneously (that is, the number of phases) may be a multiple of 3, that is, any of 3, 6, 9, 12, etc. This is effective for scanning pixels in devices of three colors for a color image display. However, any other number of signal lines will do. In general, when each of the TFTs 14*a* constituting the sampling circuit 14 exhibits a good characteristic concerning writing, a relatively small number of phases (for example, five phases or less) is adopted. When the frequency of an image signal is high, a relatively large number of phases (for example, seven phases or more) is adopted. In this case, needless to say, at least the same number of input image signal lines 9 as the number of phases of image signals is needed.

Moreover, when multiphase image signals are employed and a plurality of input image signal lines 9 are included, a transfer signal output at intervals of a plurality of stages can be sampled (See FIG. 19 to be referred to later)without using a transfer signal output from each stage of X shift register 1*a* for sampling. In this case, a plurality of TFTs 14*a* of the sampling circuit 14 are driven to conduction concurrently.

In FIG. 1, the pixel matrix 3 has an aspect ratio of 16:9 (that is, conformable to the NTSC standard on a wide screen). Each of the pixels constituting the pixel matrix 3 includes a switching device such as a thin-film transistor (TFT)and a two-terminal nonlinear device (for example, MIM device), a pixel electrode connected to the switching device, and a holding capacitor for holding charge applied to the pixel electrode. An image signal to be applied through the input image signal line 9 is supplied to each pixel over each signal line 31 via the sampling circuit 14 to be driven by the X shift register 1*a*. On the other hand, a scan signal sent from the Y shift register 2 is supplied to each pixel from each scanning line 32. The description will proceed on the assumption that the switching device of each pixel in this embodiment is realized with a TFT. In this case, the X shift register 1*a* supplies an image signal sequentially to the signal lines 31, while the Y shift register 2 applies a scan signal sequentially to the scanning lines 32. Each TFT having received a scan signal at a gate thereof is driven to conduction. An image signal supplied to arranged an associated signal line 31 is applied to a pixel electrode and a holding capacitor. When the switching device of each pixel is realized with, for example, an MIM device, the signal lines 31 and scanning lines 32 are arranged on opposed substrates and function as opposed electrodes, and pixel electrodes are connected to the signal lines 31 or scanning lines 32 arranged on a substrate having an MIM array via the MIM devices. A voltage proportional to a potential difference between an image signal and a scan signal is applied to a liquid crystal.

Herein, normally, for displaying an image of an aspect ratio 16:9, the TFTs 14*a* constituting the sampling circuit 14 are opened and closed successively by scanning a selected stage of the X shift register 1*a* from the leftmost stage to the rightmost stage. An image signal is supplied to each signal line 31 over the image input signal line 9 via a conducting TFT 14*a*. The image signal is then applied to a corresponding pixel electrode via a switching device (TFT) connected to the signal line 31. When the shifting for scan (horizontal scan) reaches the rightmost stage of the X shift register 1*a*, display of one row is completed. During a horizontal retrace period, the X shift register 1*a* is reset. For a vertical scan, a selected stage of the Y shift register 2 is shifted to a subsequent stage. The X shift register 1*a* starts the horizontal scan again at a position corresponding to the leftmost position. This sequence is repeated by the same number of times as the number of display rows, that is, the number of stages of the Y shift register 2 that is a vertical scan circuit. Thus, one frame is displayed in an image display area 4 of an aspect ratio 16:9.

When an attempt is made to display an image of an aspect ratio 4:3 using the known technique, as long as the NTSC standard is adopted, an image display area 5 corresponding to approximately six-eighths (=(4/3)/(16/9)) of the X shift register 1*a* is scanned for 53 microseconds, and non-image display areas 6 corresponding to approximately two-eighths of the X shift register 1*a* must be scanned within 11 microseconds during a horizontal retrace period (See FIG. 1). The frequency at which the non-image display areas 6 are scanned cannot help being higher than the frequency at which the image display area 5 is scanned.

In an effort to solve the above problem, according to this embodiment, an OR circuit 11 is, as shown in FIG. 2, inserted among the flip-flops 10 in the X shift register 1*a* so that a scan can be started at a position other than a position corresponding to the terminal stage (leftmost flip-flop) of the shift register 1*a*. More particularly, when a horizontal scan start signal DX1 is input to the X shift register 1*a* over the line 16, the leftmost flip-flop 10 starts generating a transfer signal. The OR circuit 11 transfers a transfer signal transferred from a left-hand flip-flop 10 to a right-hand flip-flop 10 as it is. Transfer will therefore not be interrupted by the OR circuit 11. On the other hand, when a horizontal scan start signal DX2 is input to the X shift register 1*a* over the line 17, the flip-flop 10 lying on the right-hand side of the OR circuit 11 and receiving the horizontal scan start signal DX2 via the OR circuit 11 starts generating a transfer signal. In this case, neither the transfer signal nor the horizontal scan start signal DX1 is input to the flip-flop 10 lying on the left-hand side of the OR circuit 11. The left-hand flip-flop 10 will therefore not carry out transfer.

As mentioned above, in the liquid crystal device of this embodiment, for displaying an image with an aspect ratio 4:3, a horizontal scan start signal DX2 used to display an image with the aspect ratio 4:3 is applied to the OR circuit 11 that is inserted to an input stage of a flip-flop 10 of a stage succeeding one-eighth of the number of all effective stages of the X shift register 1*a* which output a transfer signal used for sampling. A scan is then started at a pixel corresponding to a subsequent stage receiving an output of the OR circuit 11. Owing to this structure, pixels corresponding to one-eighth of the number of all effective stages are not scanned. The number of stages of the X shift register 1*a* corresponding to the non-image display areas 6 that must be scanned within 11 microseconds during a horizontal retrace period is halved, whereby a double scan time is preserved. Consequently, scanning the non-image display areas 6 can be achieved at the same frequency as the frequency at which the image display area 5 is scanned.

According to the first embodiment, as long as a liquid crystal device offers a screen with an aspect ratio 16:9 conformable to the NTSC standard on a wide screen, a wide screen and a normal screen can be displayed selectively using a relatively simple configuration. A load on an external circuit imposed by a line memory that must conventionally be included or by speed multiplication can be alleviated, and power consumption can be reduced. Moreover, an ability that is required as a characteristic of a device included in a liquid crystal device may be of the same level as the conventional one. A high-performance display device can therefore be realized at low cost. Furthermore, in the first embodiment, when the X shift register 1*a* is designed as a shift register enabling bi-directional scan, a total of four scan start positions can be designated. Moreover, the aspect ratio can be changed readily for lateral reversal or the like.

Figure 18A:
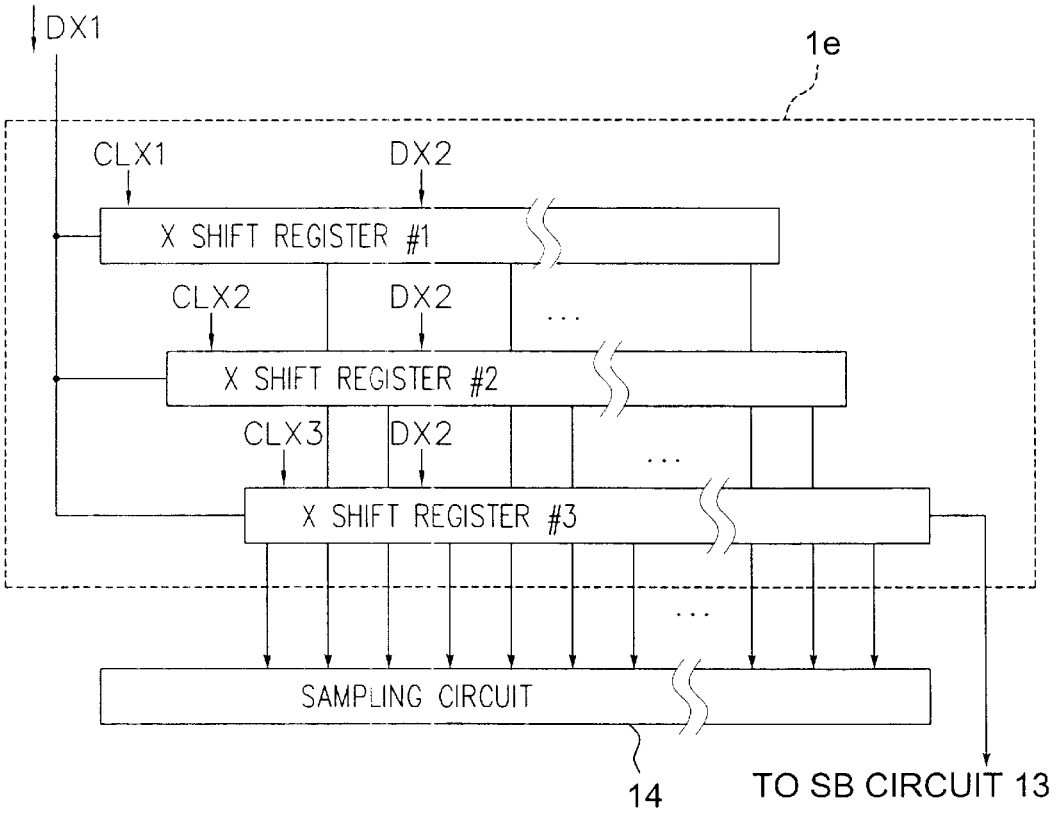
FIG. 18 is a schematic block diagram showing an X shift register of a plurality of systems adaptable to the embodiments.

Moreover, the X shift register 1*a* has been described as a shift register of one system. Needless to say, the X shift register may be configured as a shift register of a plurality of systems (See FIG. 18 to be referred to later). In this case, the shift registers of the plurality of systems may successively allow the sampling circuit 14 to output a driving signal.

Figure 3:
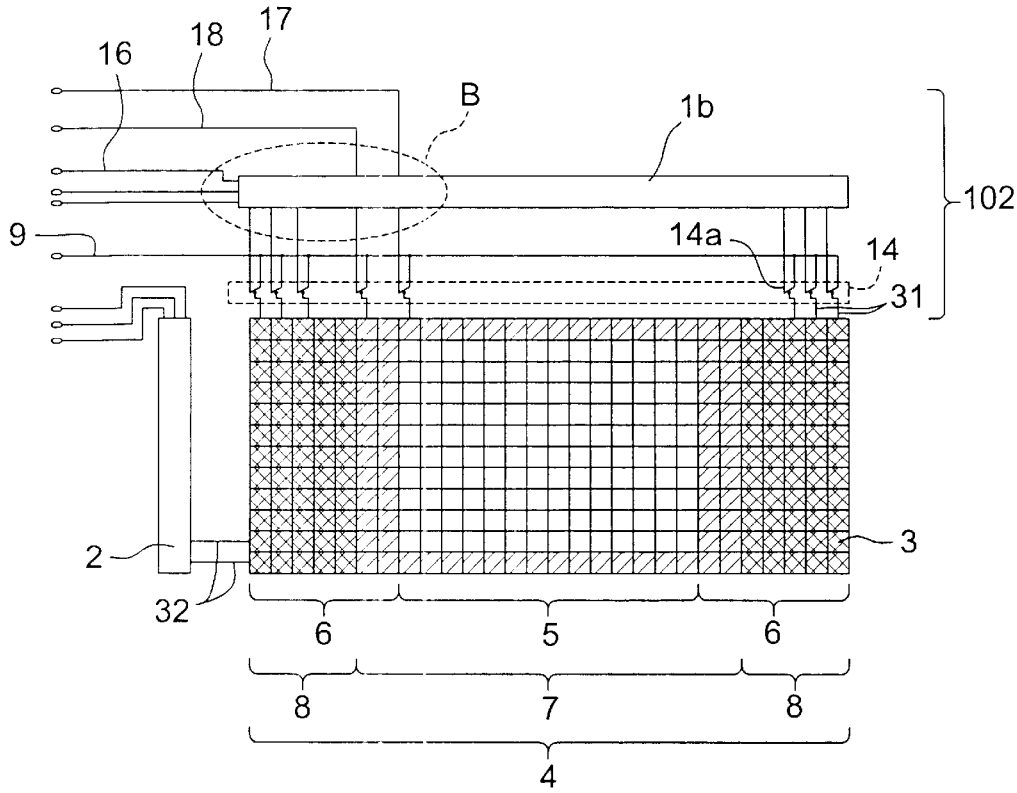
FIG. 3 is a circuit block diagram showing the second embodiment in the best mode for carrying out the present invention.
Figure 4:
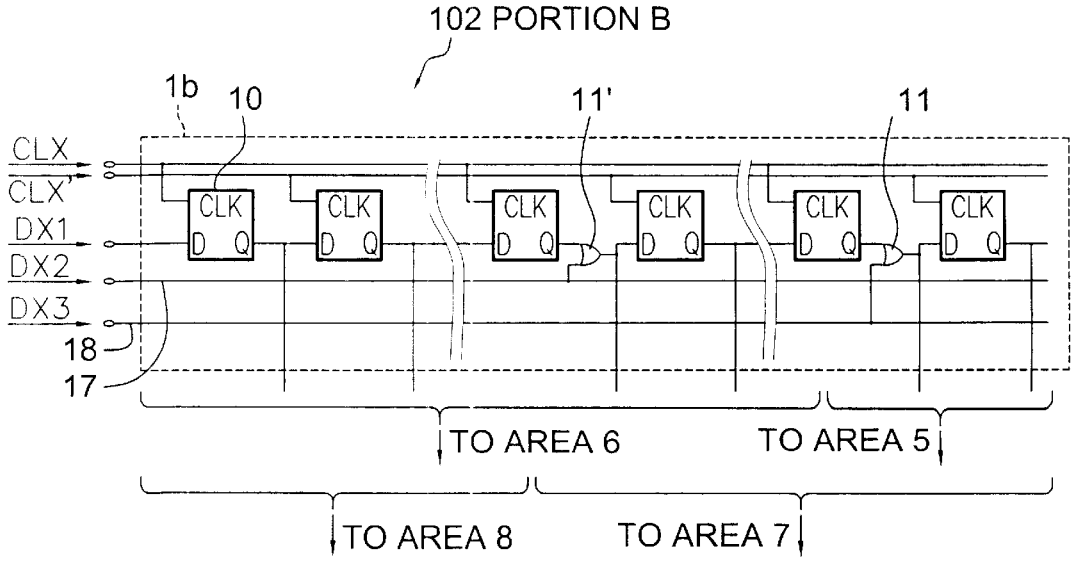
FIG. 4 is an enlarged circuit block diagram of portion B of FIG. 3.

The second embodiment will be described with reference to FIGS. 3 and 4. FIG. 3 is a circuit block diagram showing a liquid crystal device in accordance with the second embodiment, and FIG. 4 is an enlarged view of portion B of FIG. 3. In FIGS. 3 and 4, the same reference numerals are assigned to components identical to those of the first embodiment shown in FIGS. 1 and 2. The description of the components will be omitted.

The liquid crystal device shown in FIGS. 3 and 4 comprises, in addition to the same components as the components of the liquid crystal device of the first embodiment, another OR circuit to which a horizontal scan start signal is input.

To be more specific, as shown in FIG. 3, the liquid crystal device of the second embodiment has an image signal supply unit 102 composed of an X shift register 1*b*, a sampling circuit 14, and various lines (9, 16, 17, 18). As shown in FIG. 4, the X shift register 1*b* has, in addition to an OR circuit 11 to which a horizontal scan start pulse DX2 is supplied over the line 17, an OR circuit 11' to which a horizontal scan start pulse DX3 is supplied over the line 18. The X shift register 1*b* can start generating a transfer signal at a total of three positions (leftmost flip-flop 10, flip-flop 10 on the right-hand side of the OR circuit 11', and flip-flop 10 on the right-hand side of the OR circuit 11).

The liquid crystal device shown in FIG. 3 can therefore start a horizontal scan at three pixels corresponding to the above positions. The liquid crystal device of the second embodiment has a square pixel matrix 3 composed of 427 columns arranged horizontally and 260 rows arranged vertically. For displaying an image of an aspect ratio 16:9, the X shift register 1*b* is scanned horizontally from the terminal (leftmost) stage, and a total of 40 rows including the 20 uppermost rows and 20 lowermost rows of an image display area are blackened. Thus, an image is displayed in an image display area 4 having an aspect ratio 427:240=16:9. Moreover, for displaying an image of an aspect ratio 4:3 in the image display area 5, the X shift register 1*b* is scanned horizontally by shifting a selected stage from a stage corresponding to the 53rd column succeeding one non-image display area 6 by stages corresponding to 320 columns. Thus, an effective image is displayed. In a vertical direction, a total of 40 rows composed of the 20 uppermost rows and 20 lowermost rows of the image display area are blackened. Thus, an image of an aspect ratio 320:240=4:3 conformable to the NTSC standard can be displayed. Furthermore, when all 230 rows arranged vertically are used, 347 columns from the 40th column corresponding to the third scan start position newly added to the X shift register 1*b* (position of the OR circuit 11') are scanned horizontally in order to display an effective image. PAL-conformable non-image display areas 8 are skipped not to be scanned horizontally. A PAL-conformable image display area 7 of an aspect ratio 347:260=4:3 is thus provided, whereby the PAL-conformable display can be carried out.

As mentioned above, according to the second embodiment, since three or more scan start positions are provided , a wide-screen display mode as well as display modes conformable to the NTSC and PAL standard can be dealt with. In the second embodiment, the X shift register 1*b* is designed as a shift register enabling bi-directional scanning, a total of six scan start positions can be designated. Even for a lateral reversal mode or the like, the aspect ratio can be changed readily.

The X shift register 1*b* has been described as a shift register of one system. Alternatively, the X shift register may be designed as a shift register of a plurality of systems (See FIG. 18 to be referred to later). In this case, the shift registers of the plurality of systems may successively output a driving signal of the sampling circuit 14.

Figure 5:
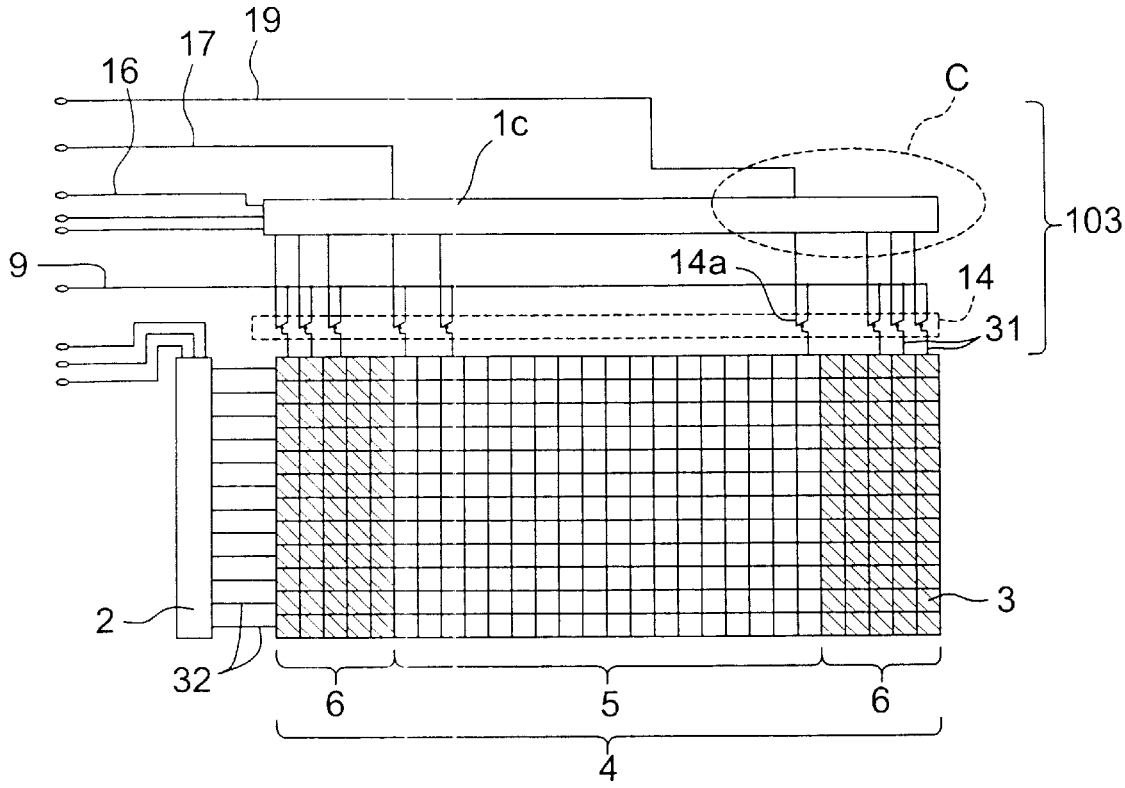
FIG. 5 is a circuit block diagram showing the third embodiment in the best mode for carrying out the present invention.
Figure 6:
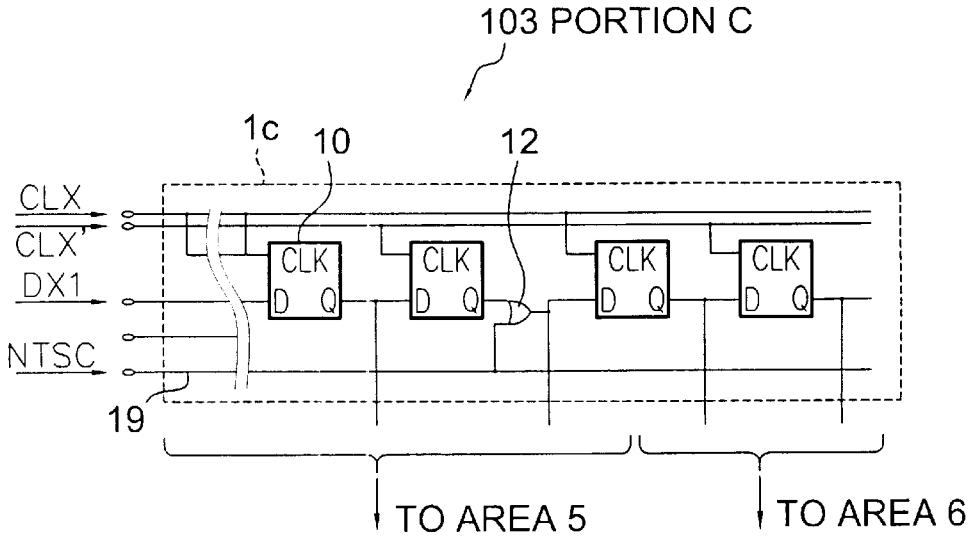
FIG. 6 is an enlarged circuit block diagram of portion C of FIG. 5.

The third embodiment will be described with reference to FIGS. 5 and 6. FIG. 5 is a circuit block diagram of a liquid crystal device in accordance with the third embodiment, and FIG. 6 is an enlarged view of portion C of FIG. 5. In FIGS. 5 and 6, the same reference numerals are assigned to components identical to those of the first embodiment shown in FIGS. 1 and 2. The description of the components will be omitted.

A liquid crystal device shown in FIGS. 5 and 6 comprises, in addition to the same components as those of the liquid crystal device in accordance with the first embodiment, an AND circuit for stopping the horizontal scan at a given position.

To be more specific, as shown in FIG. 5, the liquid crystal device of the third embodiment has an image signal supply unit 103 composed of an X shift register 1*c*, a sampling circuit 14, and various lines (9, 16, 17, 19). As shown in FIG. 6, the X shift register 1*c* includes an AND circuit 12 to which an NTSC signal is supplied over line 19. By supplying an NTSC signal that is driven in low level according to the timing that a flip-flop 10 of a stage preceding (on the left-hand side of) the AND circuit 12 outputs a transfer signal, the X shift register 1*c* can prevent the transfer signal from being transferred to a flip-flop 10 of a subsequent stage(on the right-hand side). Otherwise, when the NTSC signal is not supplied, or an NTSC signal to be driven in high level according to the timing that the flip-flop of a preceding stage outputs a transfer signal is supplied, the transfer signal can be transferred to the flip-flop 10 of a subsequent stage via the AND circuit 12. By controlling the level of the NTSC signal, the position of the AND circuit 12 can be regarded as a horizontal scan stop position, or the horizontal scan can be continued to the last (rightmost) stage beyond the AND circuit 12.

The liquid crystal device shown in FIG. 5 can start the horizontal scan at two positions and stop it at two positions. The liquid crystal device of the third embodiment has an image display area 4 with an aspect ratio 16:9. The AND circuit 12 is inserted to a stage succeeding approximately seven-eighths of the number of effective stages of the X shift register 1*c* which output a transfer signal used for sampling (approximately $\{1+(4/3)/(16/9)\}/2$). For displaying an image with an aspect ratio 4:3 in the image display area 4 of an aspect ratio 16:9, the AND circuit 12 inserted into the output stage (on the right-hand side) of flip-flop 10 corresponding to the end position of the image display area 5 of the aspect ratio 4:3 is used to stop horizontal scan. Thus, the unnecessary scanning operation of the X shift register 1*c* can be omitted.

As mentioned above, according to the third embodiment, since two-eighths of the number of stages of the X shift register 1*c* corresponding to the non-image display areas 6 may not be scanned, wasteful scan times required for scanning the two-eighths can be saved. Consequently, a load on an external circuit can be reduced drastically, and a low power consumption can be realized.

Figure 7:
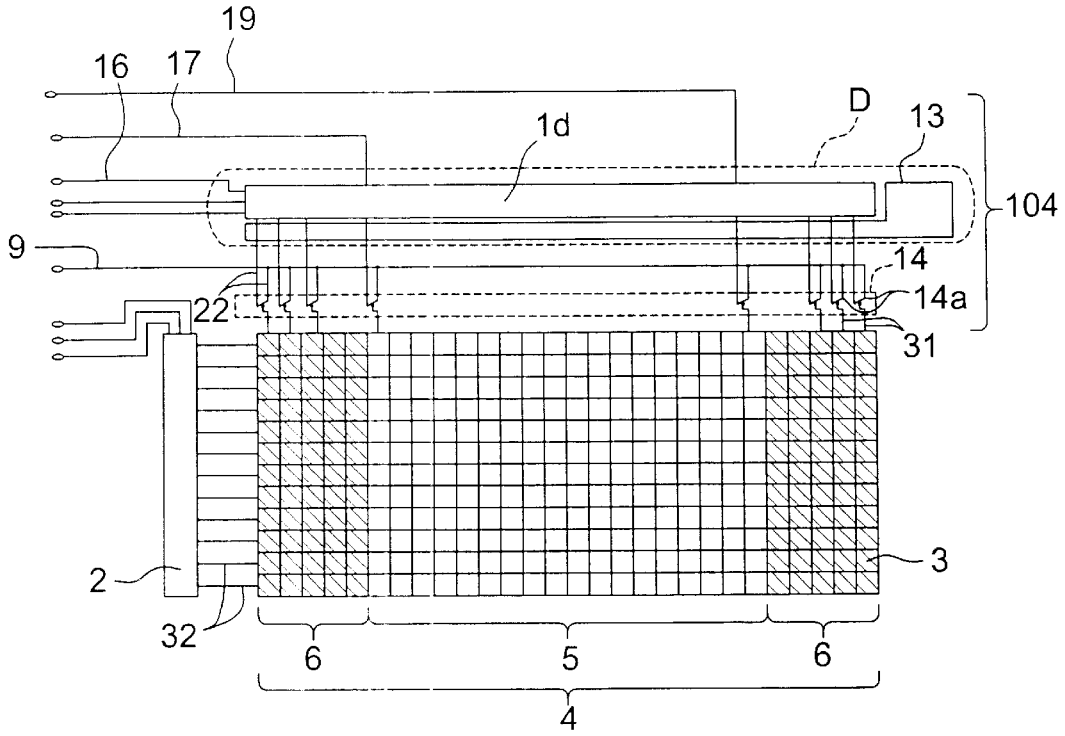
FIG. 7 is a circuit block diagram showing the fourth embodiment in the best mode for carrying out the present invention.
Figure 8:
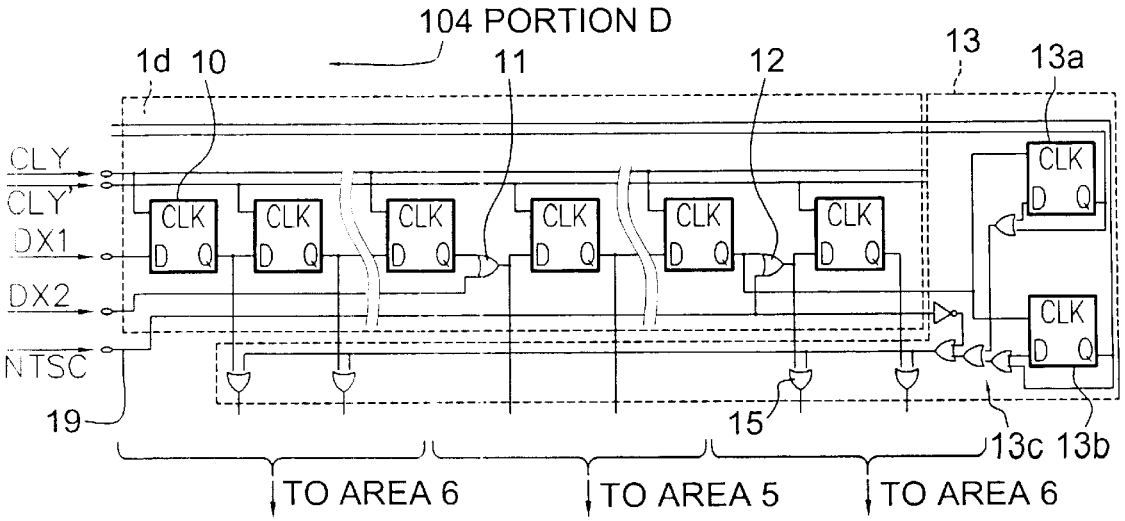
FIG. 8 is an enlarged circuit block diagram of portion D of FIG. 7.
Figure 9:
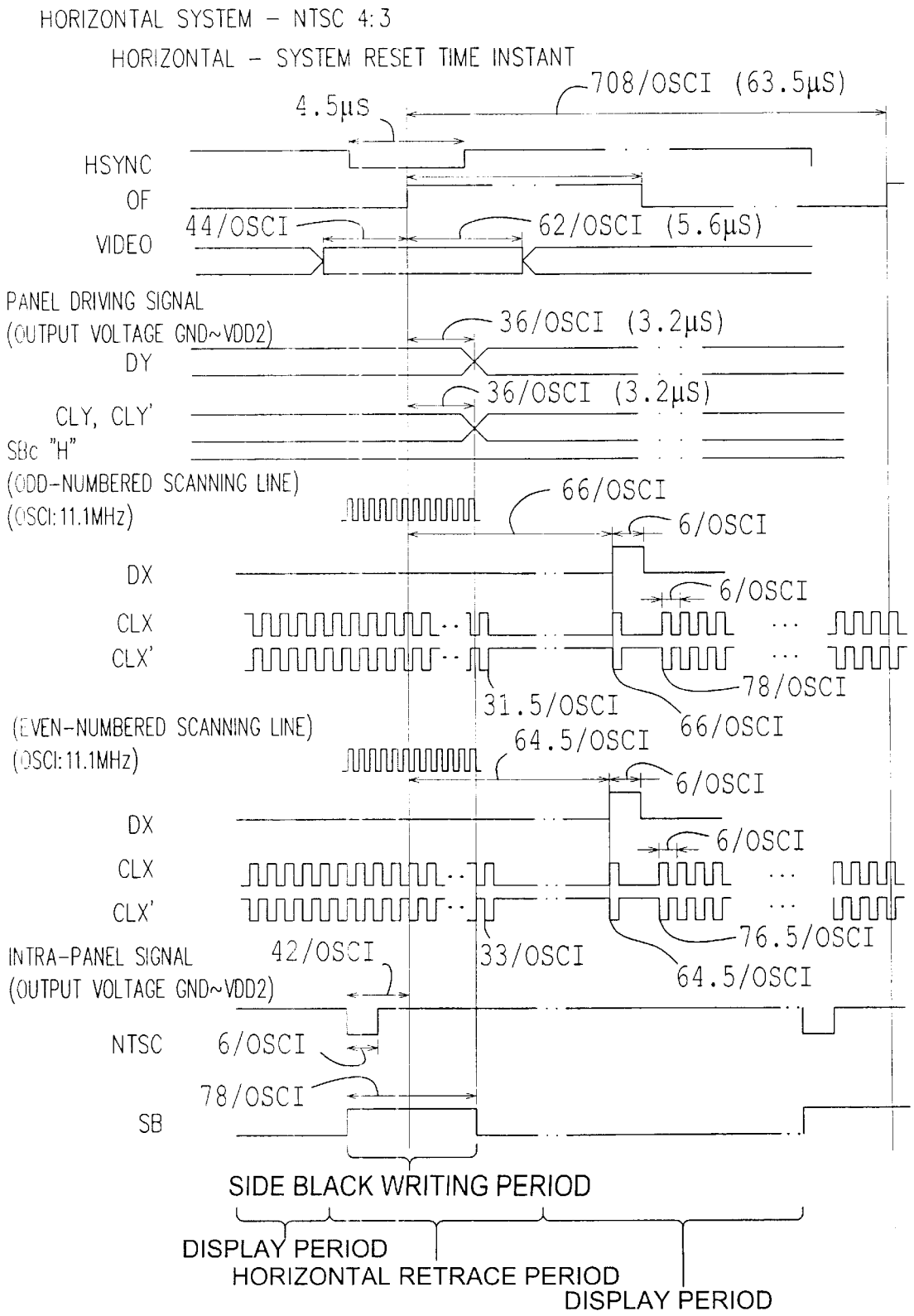
FIG. 9 is a timing chart concerning the timing of outputting various signals when an image with an aspect ratio 4:3 (NTSC standard) is displayed in a screen with an aspect ratio 16:9 (NTSC standard on a wide screen) according to the fourth embodiment.
Figure 10:
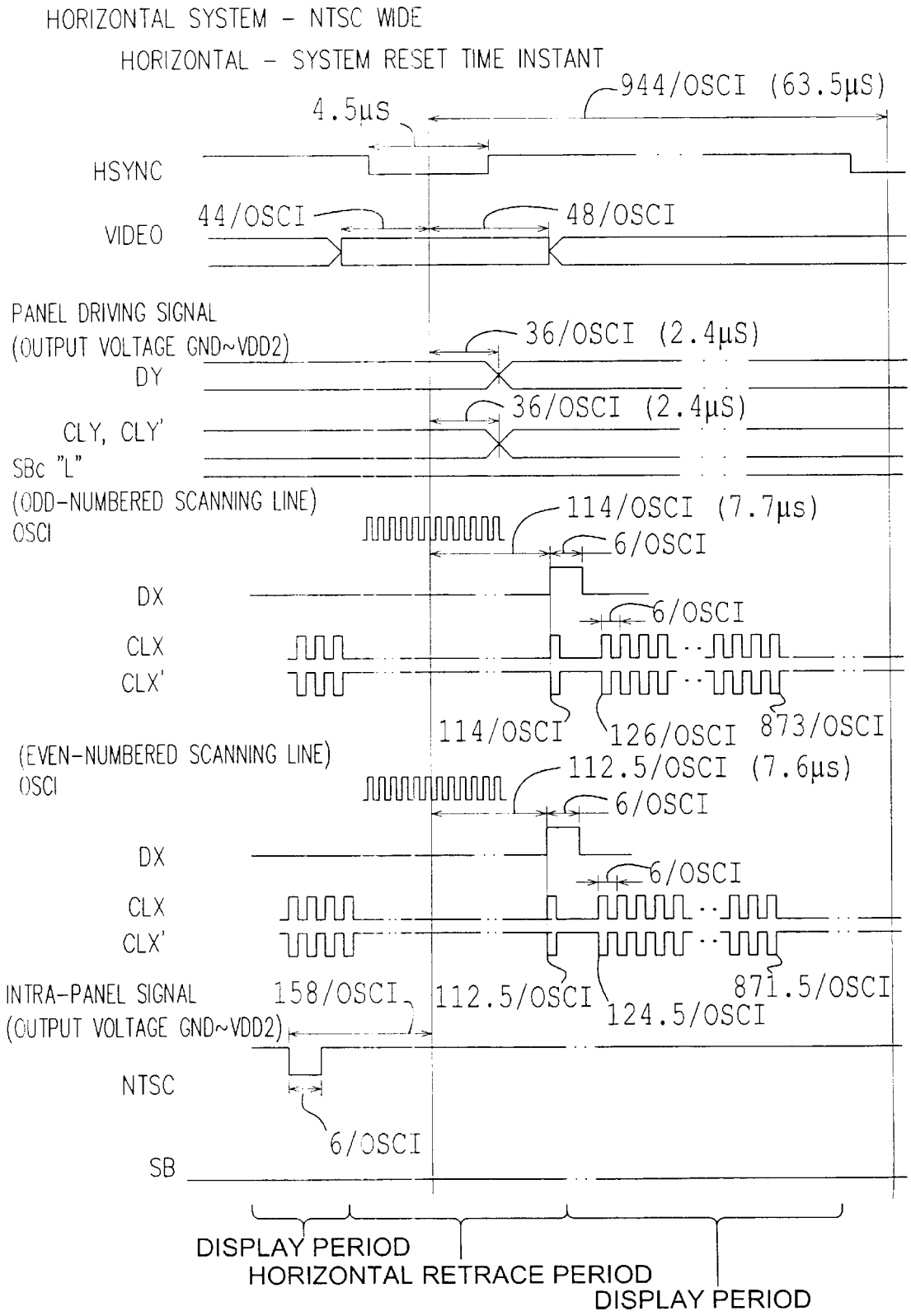
FIG. 10 is a timing chart concerning the timing of outputting various signals when an image with an aspect ratio 16:9 is displayed in a screen with an aspect ratio 16:9 according to the fourth embodiment.

Next, the fourth embodiment will be described with reference to FIGS. 7 to 10. FIG. 7 is a circuit block diagram showing a liquid crystal device in accordance with the fourth embodiment, and FIG. 8 is an enlarged view of portion D of FIG. 7. FIGS. 9 and 10 are timing charts showing timing of various signals employed in the fourth embodiment. In FIGS. 7 and 8, the same reference numerals are assigned to components identical to those of the third embodiment shown in FIGS. 5 and 6. The description of the components will be omitted.

The liquid crystal device shown in FIGS. 7 and 8 comprises, in addition to the same components as the components of the liquid crystal device of the third embodiment, a circuit for blackening non-image display areas 6 (hereinafter, a side black (SB) circuit).

To be more specific, as shown in FIG. 7, the liquid crystal device of the fourth embodiment has an image signal supply unit 104 composed of an X shift register id, a sampling circuit 14, various lines (9, 16, 17, 19), and an SB circuit 13. As shown in FIG. 8, the SB circuit 13 comprises a plurality of OR circuits 15 connected to an output signal line extending from a flip-flop 10 on the left-hand side of an OR circuit 11 used to start a horizontal scan and an output line extending from a flip-flop 10 on the right-hand side of an AND circuit 12 (for stopping the horizontal scan), a pair of flip-flops 13*a* and 13*b* for inputting a transfer signal from flip-flop 10 of a preceding (left-hand) stage of the AND circuit 12 used to stop the horizontal scan synchronously with a clock, and a logic circuit 13*c* for supplying a sampling circuit driving signal to the sampling circuit 14 simultaneously through the plurality of AND circuits 15 on the basis of outputs of the flip-flops 13*a* and 13*b* and an NTSC signal supplied through the line 19.

In the liquid crystal device of the third embodiment, no voltage is applied to pixel electrodes included in the non-image display areas 6. In liquid crystal modes including a normally-white mode, the non-image display areas appear bright. This poses a problem that since the definition of an image is impaired, the third embodiment is unsuitable for these liquid crystal modes.

However, in the fourth embodiment, as mentioned above, since the synchronized SB circuit 13 is appended to the X shift register 1*d*, the above problem is solved. Specifically, according to the fourth embodiment, for displaying an image with an aspect ratio 4:3, the SB circuit 13 is actuated when triggered by an output of a flip-flop 10 of a stage of the X shift register id corresponding to the last position of the image display area 5. This causes the TFTs 14*a* of the sampling circuit 14 corresponding to the non-image display areas 6 to conduct owing to the AND circuits 15. Consequently, a black display signal supplied over line 9 can be applied to the pixels constituting the non-image display areas.

When a plurality of systems of X shift registers are included to successively output a driving signal to the sampling circuit 14 (See FIG. 18 to be referred to later), a flip-flop 10 for outputting a last driving signal among flip-flops included in the plurality of systems of shift registers is regarded as the last stage. The output of the last-stage flip-flop 10 is used to trigger actuation of the SB circuit 13.

Next, operations performed in the fourth embodiment having the foregoing components will be described with reference to the timing charts of FIGS. 9 and 10. The timing concerning the start of the horizontal scan to be described below is also adopted in the first to third embodiments. The timing concerning the stop of the horizontal scan to be described below is also adopted in the third embodiment.

To begin with, referring to FIG. 9, operations to be performed for displaying an image with an aspect ratio 4:3 conformable to the NTSC standard will be described in relation to the liquid crystal device, which offers a screen with an aspect ratio 16:9 conformable to the NTSC standard on a wide screen, shown in FIGS. 7 and 8.

As shown in FIG. 9, a horizontal synchronizing signal HSYN having a pulse duration of 4.5 microseconds is input from an image signal source such as a TV tuner or video player to an external image signal processing circuit such as an image signal processing IC at intervals of 63.5 microseconds equivalent to 708/reference frequency for oscillation (OSCI). An OF signal that is driven high at a horizontal-system reset time instant is input to the external image signal processing circuit. Also input is an image signal VIDEO whose effective image signal responsible for actual display ceases a time equivalent to 44/OSCI earlier than the horizontal-system reset time instant during each horizontal scan period (horizontal display period+horizontal retrace period), and begins after a time (5.6 microseconds) equivalent to 62/OSCI.

The external image signal processing circuit in turn inputs a vertical scan start signal DY and a clock signal CLY (and its reverse clock signal CLY') as a panel driving signal to the Y shift register 2 after 3.2 microseconds equivalent to 36/OSCI from the horizontal-system reset time instant.

Also input is a side black control signal SBc that is driven in high level for indicating that side black (SB) writing is carried out.

Furthermore, when a horizontal scan is carried out in order to form a field composed of odd-numbered scanning lines (263 scanning lines under the NTSC standard), a horizontal scan start signal DX having a pulse duration equivalent to 6/OSCI is input to the X shift register 1*a* after a time equivalent to 66/OSCI from the horizontal-system reset time instant. Also input is a clock signal CLX (and its reverse clock signal CLX') having a cycle equivalent to 6/OSCI and being synchronous with the pulses of the horizontal scan start signal. When a horizontal scan is carried out in order to form a field composed of even-numbered scanning lines (262 scanning lines), a horizontal scan start signal DX having a pulse duration equivalent to 6/OSCI is input to the X shift register 1*a* after a time equivalent to 64.5/OSCI from the horizontal-system reset time instant. Also input is a clock signal CLX having a cycle equivalent to 6/OSCI and being synchronous with the pulses of the horizontal scan start signal (and its reverse clock signal CLX'). Incidentally, the reference frequency for oscillation OSCI is 11.1 MHz.

Based on these panel driving signals, the X shift register 1*a* drives the sampling circuit 14. Especially in this case, since the side black control signal SBc is high, a horizontal scan start signal DX (signal DX2 in FIG. 2) is input to the OR circuit 11 over the line 17. The horizontal scan is therefore started at a flip-flop 10 on the right-hand side of the OR circuit 11. Image display is carried out from a column of pixels connected to a signal line 31 associated with the flip-flop according to an image signal VIDEO. In short, effective image display is achieved in the image display area 5.

At a time instant equivalent to 42/OSCI earlier than the horizontal-system reset time instant, the external image signal processing circuit inputs an NTSC signal having a pulse duration equivalent to 6/OSCI. A time equivalent to 78/OSCI within a horizontal retrace period from the trailing end time of the NTSC signal is regarded as a side black writing period. During the period, a side black writing signal SB is driven high. While the signal SB is high, a column of pixels connected to a signal line 31 associated with a flip-flop 10 lying on the left-hand side of the OR circuit 11 and a column of pixels connected to a signal line 31 associated with a flip-flop 10 lying on the right-hand side of the AND circuit 12 are blackened according to a component of an image signal VIDEO representing a black level and being supplied over the input image signal line 9. In short, the non-image display areas 6 are blackened.

Next, referring to FIG. 10, operations to be performed for displaying an image of an aspect ratio 16:9 conformable to the NTSC standard on a wide screen will be described in relation to the liquid crystal device, which offers a screen of an aspect ratio 16:9 conformable to the NTSC standard on a wide screen, shown in FIG. 1. In this case, an effective image represented by an image signal is displayed in the whole pixel matrix 3 (that is, the image display area 4). The special control for blackening the right and left margins of the image display area is not needed.

As shown in FIG. 10, a horizontal synchronizing signal HSYN having a pulse duration of 4.5 microseconds is input from the image signal source to the external image signal processing circuit at intervals of a time equivalent to 944/OSCI. Input is an image signal VIDEO that begins after a time equivalent to 48/OSCI from the horizontal-system reset time instant during each horizontal scan period.

In response to the input signals, the external image signal processing circuit inputs a vertical scan start signal and a clock signal CLY (and its reverse clock signal CLY') as panel driving signals to the Y shift register 2 after a time equivalent to 36/OSCI from the horizontal-system reset time instant. Also input is a side black control signal SBc that is driven in low level for indicating that side black (SB) writing is not carried out.

When a horizontal scan is carried out for forming a field composed of odd-numbered scanning lines, a horizontal scan start signal DX having a pulse duration equivalent to 6/OSCI is input to the X shift register 1*a* after a time equivalent to 114/OSCI from the horizontal-system reset time instant. Also input is a clock signal CLX (and its reverse clock signal CLX') having a cycle equivalent to 6/OSCI and being synchronous with the pulse signal. When the horizontal scan is carried out for forming a field composed of even-numbered scanning lines, a horizontal scan start signal DX having a pulse duration equivalent to 6/OSCI is input to the X shift register 1*a* after a time equivalent to 112.5/OSCI from the horizontal scan start time instant. Also input is a clock signal CLX (and its reverse clock signal CLX') having a cycle equivalent to 6/OSCI and being synchronous with the pulse signal. Incidentally, the reference frequency for oscillation OSCI is 11.1 MHz.

Based on the panel driving signals, the X shift register 1*a* drives the sampling circuit 14. Especially in this case, since the signal SBc is low, a horizontal scan start signal DX (signal DX1 in FIG. 2) is input over the line 16. The horizontal scan is therefore started at a position corresponding to the leftmost flip-flop 10. Image display is carried out from a column of pixels connected on a signal line 31 associated with the flip-flop according to an image signal VIDEO. Thus, effective image display is achieved in the image display area 4.

In this case, an NTSC signal having a pulse duration equivalent to 6/OSCI is input from the external image signal processing circuit at a time instant that is 158/OSCI earlier than the horizontal-system reset time instant. However, a side black writing signal SB remains low all the time. No area will not be blackened with a side black signal.

As detailed above, according to the fourth embodiment, the SB circuit 13 operates during a majority of a horizontal retrace period that is regarded as a pixel writing time. Sufficiently long-term writing can be realized. This enables display of an electricity parting frame which requires a very high contrast.

Figure 11:
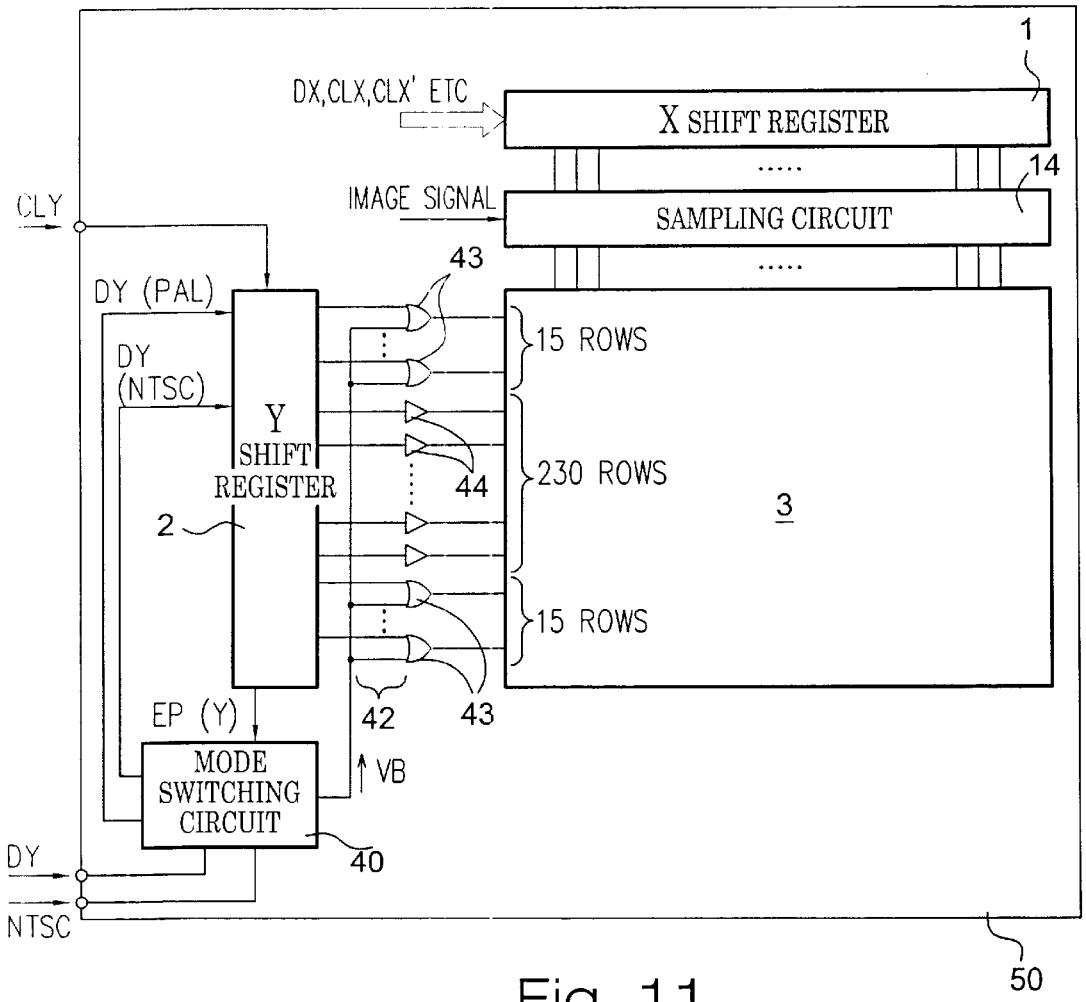
FIG. 11 is a circuit block diagram showing the fifth embodiment in the best mode for carrying out the present invention.
Figure 12:
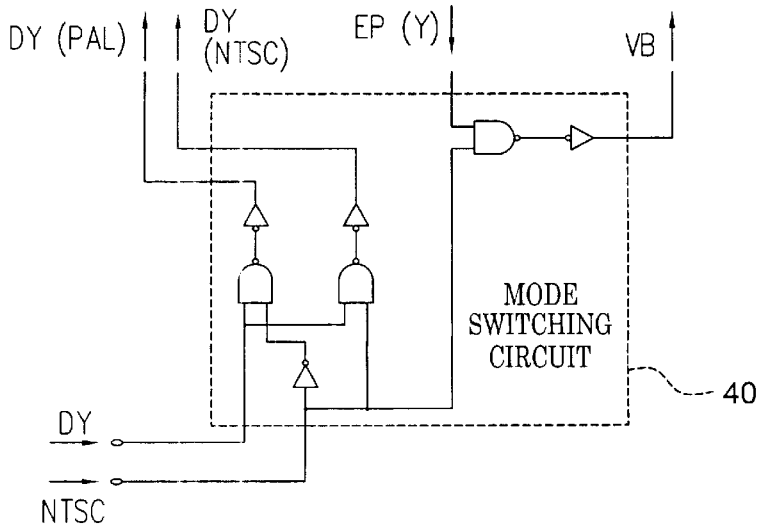
FIG. 12 is a circuit block diagram showing a mode switching circuit shown in FIG. 11.

Next, the fifth embodiment will be described with reference to FIGS. 11 to 13. FIG. 11 is a circuit block diagram showing a liquid crystal device in accordance with the fifth embodiment, FIG. 12 is a circuit block diagram showing the mode switching circuit shown in FIG. 11, and FIG. 13 is a timing chart concerning various signals employed in the fifth embodiment. In FIG. 11, the same reference numerals are assigned to components identical to those of the first embodiment shown in FIG. 1. The description of the components will be omitted.

In FIG. 11, the liquid crystal device comprises a pixel matrix 3 formed on a TFT array substrate 50, an X shift register (any of the X shift registers 1*a* to 1*d* employed in the first to fourth embodiments), a sampling circuit 14, and a Y shift register 2. In addition, the liquid crystal device comprises a mode switching circuit 40 for switching a display mode in which the whole of the pixel matrix 3 is used as an image display area, and a display mode in which the uppermost and lowermost areas with a certain width of the pixel matrix 3 are regarded as non-image display areas, and a logic circuit device 42 including a plurality of OR circuits 43 and a plurality of buffers 44.

In this embodiment, the aspect ratio of the pixel matrix 3 is 4:3. Mode switching to be described below is switching of a PAL-conformable display mode (aspect ratio 4:3) and an NTSC on wide screen-conformable display mode (aspect ratio 16:9). Specifically, in the PAL-conformable display mode, the whole pixel matrix is regarded as an image display area. In the NTSC on wide screen-conformable display mode, the uppermost and lowermost areas with a certain width of a screen are regarded as non-image display areas.

As shown in FIG. 12, in addition to a vertical scan start signal DY, an NTSC signal, that is driven high for indicating the NTSC on wide screen-conformable display mode, and driven low for indicating the PAL-conformable display mode, is input from the external image signal processing circuit to the mode switching circuit 40. According to the level of the NTSC signal, a start pulse DY(NTSC) used for NTSC on wide screen-conformable display or a start pulse DY(PAL) used for PAL-conformable display is output from the mode switching circuit 40 to the Y shift register 2. When the start pulse DY(NTSC) used for NTSC on wide screen-conformable display is input to the Y shift register 2, scanning lines of the central 230 rows located between the 16th uppermost rows and the 16th lowermost rows are scanned vertically. With input of the start pulse DY(PAL) used for PAL-conformable display, the scanning lines of all 260 rows are scanned vertically.

The mode switching circuit 40 is designed so that when an End pulse signal EP(Y) is input from the Y shift register 2, if an NTSC signal is high, a signal VB used to blacken the 15 uppermost rows and the 15 lowermost rows is output to the OR circuits 43 connected on the scanning lines of these rows. In this case, when a component of an image signal VIDEO representing a black level for the rows is supplied to the signal lines, the 15 uppermost rows and the 15 lowermost rows of the pixel matrix 3, which receive the signal VB via the OR circuits 43, are blackened all the time. When the NTSC signal is low, the mode switching circuit 40 does not output the signal VB. In this case, the 15 uppermost rows and the 15 lowermost rows of the pixel matrix 3 will not be blackened, but effective image display will be achieved in conformity with the PAL standard.

Next, operations to be performed in the fifth embodiment having the foregoing components will be described with reference to the timing chart of FIG. 13.

To begin with, referring to FIG. 13A, operations to be performed when an NTSC signal is low (that is, in the PAL-conformable display mode) will be described.

Figure 13A:
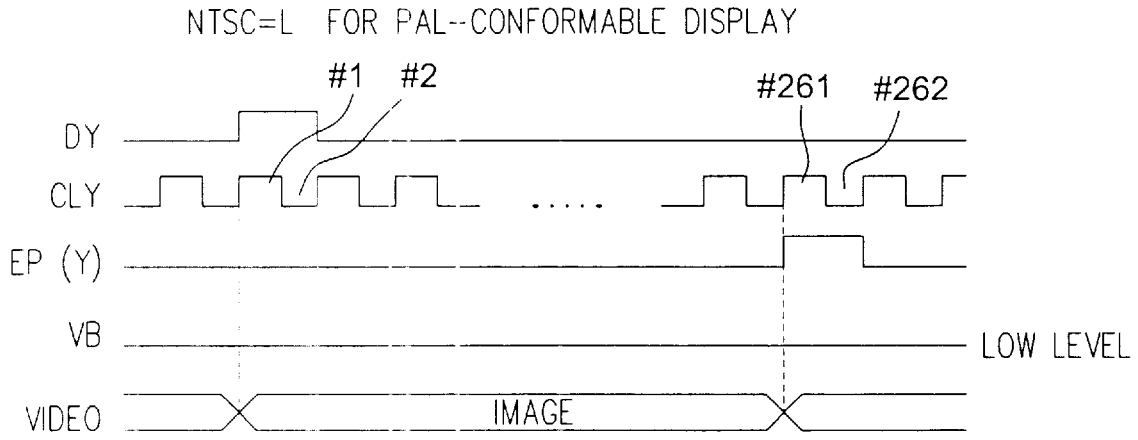
FIG. 13A is a timing chart concerning the timing of outputting various signals when an image with an aspect ratio 4:3 (PAL standard) is displayed in a screen with an aspect ratio 4:3 according to the fifth embodiment.

As shown in FIG. 13A, when a vertical scan start signal DY is input, the 260 rows are horizontally scanned with each clock pulse Nos. 1 to 260. Thereafter, an End pulse signal EP(Y) is output. Since a signal VB is low all the time, the uppermost and lowermost areas will not be blackened in particular. While the 260 rows are scanned horizontally, an image signal VIDEO is supplied so that an image with an aspect ratio 4:3 is displayed in the whole pixel matrix 3 in conformity with the PAL standard.

Next, referring to FIG. 13B, operations to be performed when an NTSC signal is high (that is, in the NTSC on wide screen-conformable display mode) will be described.

Figure 13B:
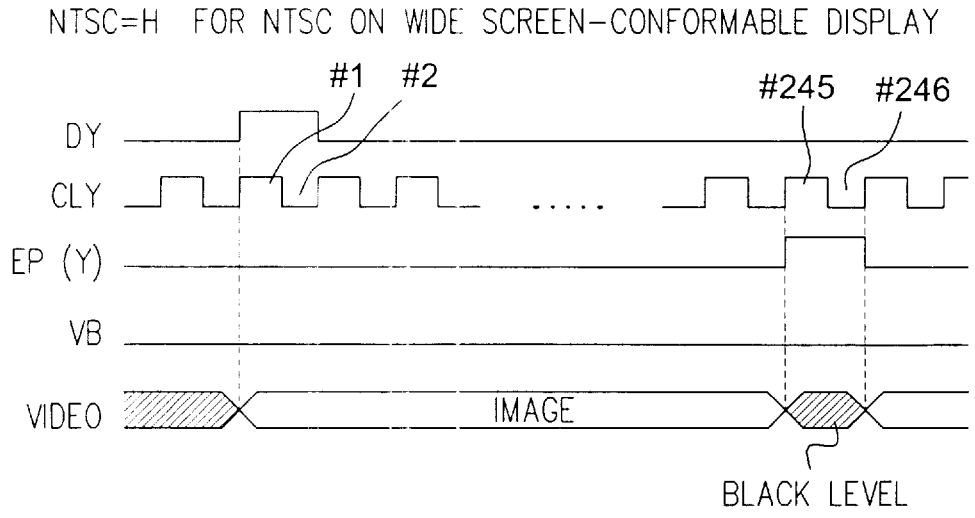
FIG. 13B is a timing chart concerning the timing of outputting various signals when an image with an aspect ratio 16:9 (NTSC standard on a wide screen) is displayed in a screen with an aspect ratio 4:3 according to the fifth embodiment.

As shown in FIG. 13B, when a vertical scan start signal DY is input, 245 rows are horizontally scanned with each clock pulse Nos. 1 to 245. Thereafter, an End pulse signal EP(Y) is output. The mode switching circuit 40 outputs a signal VB. The signal VB is supplied to TFTs in pixels constituting the 15 uppermost rows and the 15 lowermost rows via the OR circuits 43. This causes all the TFTs to conduct. Consequently, the 15 uppermost rows and 15 lowermost rows are blackened according to a component of an image signal VIDEO representing a black level, and an effective display is achieved on the central 245 rows according to the image signal VIDEO.

As mentioned above, according to the fifth embodiment, when the size of the display screen is inconsistent with the size of the display image, the uppermost and lowermost areas of the pixel matrix can be blackened. By blackening the right and left areas thereof as well, an image of any desired size can be displayed in the display screen of a certain size provided by the pixel matrix 3. This is quite convenient.

Talking of the Y shift register 2, two identical circuits may be installed on the right and left sides of the scanning lines so that they can drive the same scanning lines at both ends of the scanning lines. Moreover, the Y shift register 2 may be bisected, and two Y shift registers may be located at the right and left ends of the scanning lines so that the left-hand Y shift register and right-hand Y shift register can drive a scanning line alternately. In either case, the OR circuits 43 are inserted in one-to-one correspondence with outputs of the Y shift registers to be applied to the non-image display areas.

Figure 14:
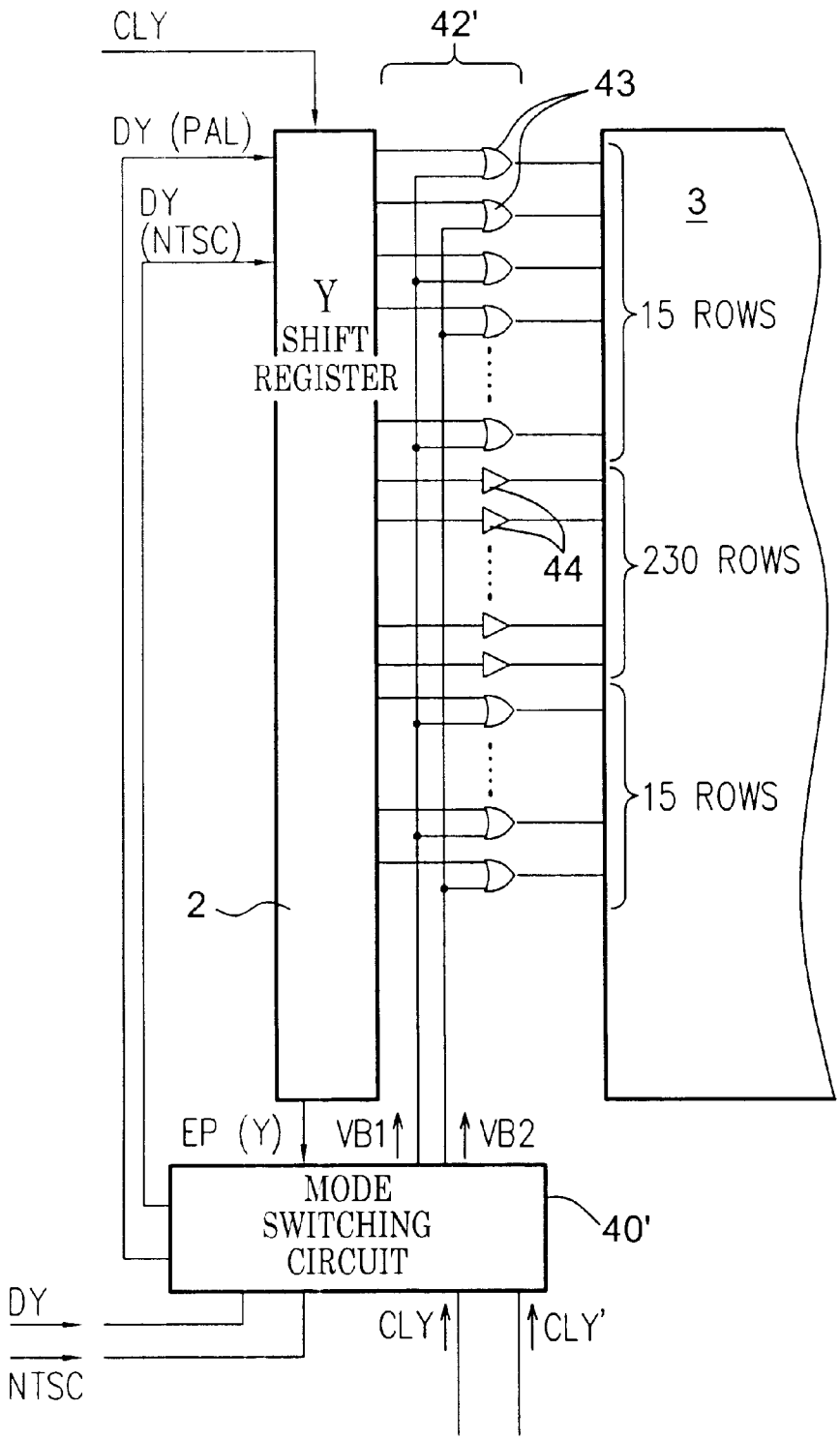
FIG. 14 is a circuit block diagram showing the sixth embodiment in the best mode for carrying out the present invention.
Figure 15:
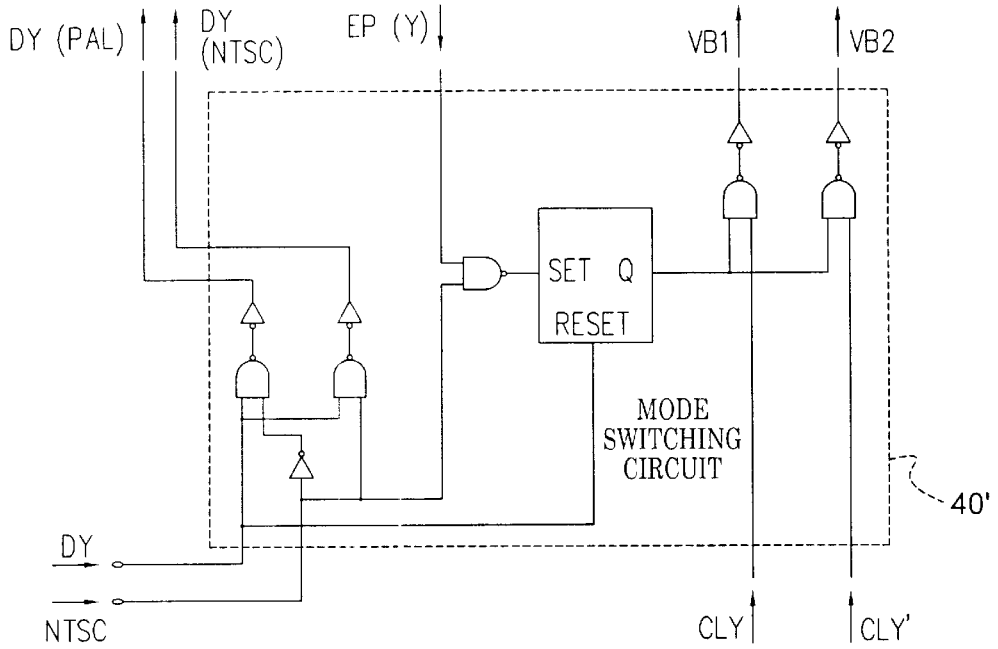
FIG. 15 is a circuit block diagram of a mode switching circuit shown in FIG. 14.
Figure 16:
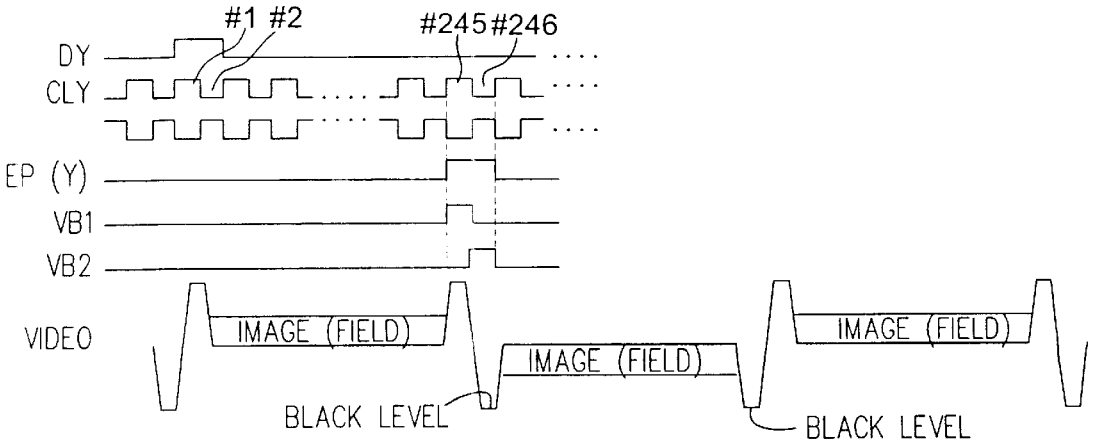
FIG. 16 is a timing chart concerning the timing of outputting various signals when an image with an aspect ratio 16:9 is displayed in a screen with an aspect ratio 4:3 according to the sixth embodiment.

Next, the sixth embodiment will be described with reference to FIGS. 14 to 16. FIG. 14 is a block diagram showing a major circuit of a liquid crystal device of the fifth embodiment, FIG. 15 is a circuit block diagram showing a mode switching circuit shown in FIG. 11, and FIG. 16 is a timing chart concerning various signals employed in the sixth embodiment. In FIG. 14, the same reference numerals are assigned to components identical to those of the first embodiment shown in FIG. 1. The description of the components will be omitted.

In the fifth embodiment, one signal VB is used to blacken the uppermost and lowermost areas with a certain width of the pixel matrix 3. In the sixth embodiment, two signals VB1 and VB2 that are mutually out of phase are used to blacken the uppermost and lowermost areas.

In general, for preventing deterioration of a liquid crystal, it is necessary to drive the liquid crystal with an alternating current. A typical AC driving method is a field reversal driving method in which the polarity of an image signal is reversed for each field (or frame). An AC driving method helpful in preventing occurrence of flickers in a display image is a 1 H reversal driving method in which the polarity of an image signal is reversed for each scanning line (each row). The sixth embodiment provides a liquid crystal device capable of blackening the uppermost and lowermost areas of a pixel matrix according to the field reversal driving method or the 1 H reversal driving method.

Specifically, referring to FIG. 14, the liquid crystal device comprises any of the X shift registers 1*a*, 1*b*, 1*c*, and 1*d* of the first to fourth embodiments, and the sampling circuit 14 which are not illustrated. The liquid crystal device further comprises, in addition to the pixel matrix 3 and Y shift register 2, a mode switching circuit 40' for switching a display mode in which the whole pixel matrix 3 is regarded as an image display area and a display mode in which the uppermost and lowermost areas with a certain width of the pixel matrix 3 are regarded as non-image display areas, and a logic circuit device 42' including a plurality of OR circuits 43.

In this embodiment, like the fifth embodiment, the aspect ratio of the pixel matrix 3 is 4:3. As for mode switching, switching a PAL-conformable display mode and NTSC on wide screen-conformable display mode will be described.

As shown in FIG. 15, in addition to a horizontal scan start signal DY, an NTSC signal is input to the mode switching circuit 40' in the same manner as that in the fifth embodiment. According to the level of the NTSC signal, a start pulse DY(NTSC) or start pulse DY(PAL) is output to the Y shift register 2.

Herein, when an End pulse signal EP(Y) is input from the Y shift register 2, if the NTSC signal is high, the mode switching circuit 40' outputs signals VB1 and VB2, used to blacken the uppermost and lowermost areas alternately, to the OR circuits 43 connected to the scanning lines of the 15 uppermost rows and the 15 lowermost rows. In particular, a clock signal CLY (and its reverse clock signal CLY') is input to the mode switching circuit 40'. The signals VB1 and VB2 are mutually out of phase by a half cycle of the clock signal CLY. In this case, a component of an image signal VIDEO representing image data to be written in the 15 uppermost rows and the 15 lowermost rows of the pixel matrix 3, which receive the signals VB1 and VB2 via the OR circuits 43, are supplied to the signal lines so that a voltage in a black level whose polarity is reversed for each field, frame, or scanning line will be applied to the liquid crystal portions of the rows. Thus, the 15 uppermost rows and the 15 lowermost rows are blackened all the time. When the NTSC signal is low, the mode switching circuit 40' does not output the signals VB1 and VB2. In this case, the 15 uppermost rows and the 15 lowermost rows of the pixel matrix 3 will not be blackened, but an effective image display will be achieved in conformity with the PAL standard.

Next, operations to be performed in the sixth embodiment having the foregoing components will be described with reference to the timing chart of FIG. 16. When the NTSC signal is low (that is, in the PAL-conformable display mode), the signals VB1 and VB2 are not output. The resultant operations are identical to those performed in the fifth embodiment and described in FIG. 13A. The description of the operations will be omitted. Operations to be performed when the NTSC signal is high (that is, in the NTSC on wide screen-conformable display mode) will be described.

As shown in FIG. 16, when a vertical scan start signal DY is input, 245 rows are horizontally scanned with each clock pulse Nos. 1 to 245. Thereafter, an End pulse signal EP(Y) is output. The mode switching circuit 40' then outputs a high-level signal VB1 during the first half cycle of the End pulse signal EP(Y). Moreover, a high-level signal VB2 is output during the second half cycle of the End pulse signal EP(Y). The signals VB1 and VB2 are supplied to TFTs in pixels constituting the 15 uppermost rows and the 15 lowermost rows via the OR circuits 43. This causes all the TFTs to conduct. The 15 uppermost rows and the 15 lowermost rows of the pixel matrix are blackened according to an image signal VIDEO representing a black level and being reversed in polarity for each field or scanning line. An effective display is achieved on the central 245 rows according to an image signal VIDEO that the liquid crystal applied voltage is reversed in polarity for each field, frame, or scanning line. The liquid crystal applied voltage is a voltage to be applied to the liquid crystal sandwiched between the pixel electrodes and opposed electrodes (common electrodes) arranged on the substrate opposed to the substrate having the pixel electrodes according to a difference voltage between the pixel electrodes and opposed electrodes.

With respect to the Y shift register 2, two identical circuits may be installed on the right and left sides of the scanning lines so that they can drive the same scanning lines at both ends of the scanning lines. The Y shift register 2 may be bisected, and the resultant two Y shift registers may be arranged on the right-hand and left-hand sides of the scanning lines so that the left-hand Y shift register and right-hand Y shift register can drive the scanning lines alternately. In either case, the OR circuits 43 are inserted in one-to-one correspondence with outputs of the Y shift registers to be applied to the non-image display areas.

As mentioned above, according to the sixth embodiment, the uppermost and lowermost areas of the pixel matrix 3 can be blackened. In addition, the uppermost and lowermost non-image display areas are blackened according to the field-by-field or frame-by-frame reversal driving method or the 1 H reversal driving method. Deterioration of the liquid crystal portions of the non-image display areas caused by DC driving can be effectively prevented. In particular, when the 1 H reversal driving method for reversing the polarity of an image signal for each scanning line is adopted, flickers in a display image can be prevented. This is quite advantageous in practice.

The aforesaid embodiments include an embodiment in which a selected stage to be shifted to a subsequent one in an X shift register or Y shift register can be set to an intermediate stage, an embodiment in which the X shift register can be shift-stopped in an intermediate stage, and an embodiment in which blackening is carried out according to the field reversal driving method or the 1 H reversal driving method. The embodiments may be combined to such an extent that the gist of the present invention will not be contradicted. That is to say, shifting a selected stage may be started or stopped with any intermediate stage corresponding to any position in the rightmost, leftmost, uppermost, or lowermost area of a pixel matrix. An AC driving method other than the field-by-field or frame-by-frame reversal driving method or the 1 H reversal driving method may be adopted in order to blacken the rightmost and leftmost non-image display areas or the uppermost and lowermost non-image display areas. Moreover, a high-level signal VB may be assigned to every $n^{th}$ row.

In the aforesaid embodiments, a liquid crystal panel having TFTs formed on an insulating substrate has been taken for example. In the case of a reflective liquid crystal panel having a liquid crystal sandwiched between a semiconductor substrate and a glass substrate, devices formed with TFTs may be rearranged with MOS transistors formed on the semiconductor substrate.

Figure 17A:
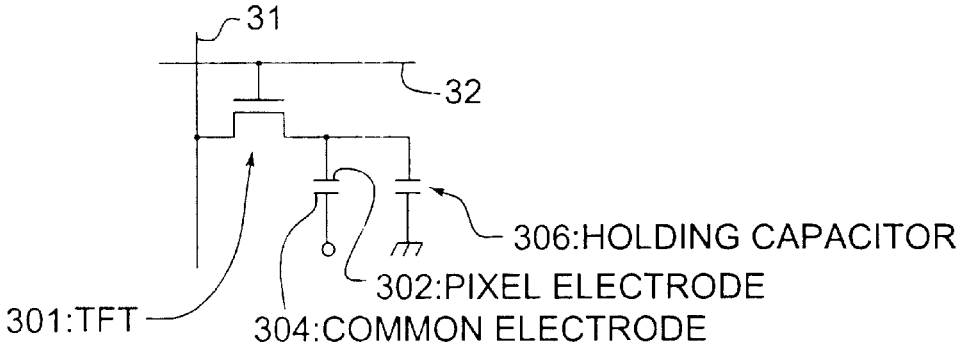
FIG. 17A is a circuit diagram showing a pixel in which a switching device is realized with a TFT.
Figure 17B:
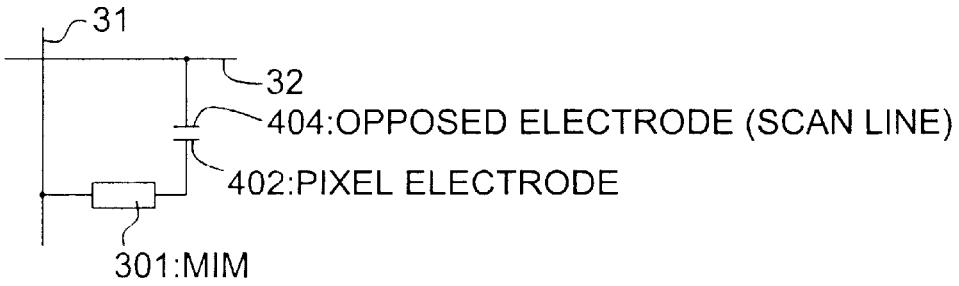
FIG. 17B is a circuit diagram showing a pixel in which a switching device is realized with a MIM device.

In the aforesaid embodiments, the configuration in which switching devices in pixels are realized with TFTs have been taken for example. In the embodiments, the switching devices in the pixels may be realized with MIM devices. As shown in FIG. 17A, when each switching element is realized with a TFT 301, the source (or drain) of the TFT 301 is connected to a signal line 31 and the gate of the TFT 301 is connected to a scanning line 32. A pixel electrode 302 is connected to the drain (or source) of the TFT 301. A common electrode 304 formed on an opposed substrate is opposed to the pixel electrode 302 with a liquid crystal inbetween. A holding capacitor 306 is connected in parallel with the pixel electrode 302. In contrast, when each switching device is, as shown in FIG. 17B, formed with an MIM device 401, one terminal of the MIM device 401 is connected to a signal line 31, and a pixel electrode 402 is connected to the other terminal of the MIM device 401. The scanning line 32 is partly used as an opposed electrode 404 opposed to the pixel electrode 402 with a liquid crystal inbetween.

Figure 18B:
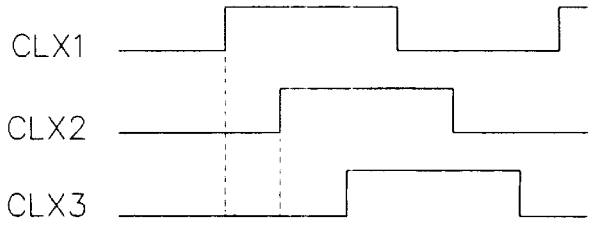

In relation to the aforesaid embodiments, the X shift register has been described as a shift register of one system. The X shift registers in the embodiments may be designed as a shift register 1*e* of a plurality of systems which include the three X shift registers No. 1, No. 2, and No. 3. In this case, as shown in FIG. 18B, clock signals CLX1, CLX2, and CLX3 that are mutually out of phase are used as clock signals associated with shift registers Nos. 1, 2, and 3. Three kinds of transfer signals that are mutually out of phase proportionally to the phase shift among the clock signals are output successively from the shift register le of a plurality of systems. Sampling is carried out sequentially according to the timing of the three kinds of transfer signals. When an X shift register is designed as a shift register of a plurality of systems, the start and stop of transfer can be controlled by inserting a logic circuit having the same configuration as the one described in each embodiment to an input terminal of a flip-flop 10 included in each shift register and corresponding to the start position of an image display area, through which a transfer signal is input, and to an output terminal of a flip-flop 10 corresponding to the end position thereof, through which a transfer signal is output.

Figure 19:
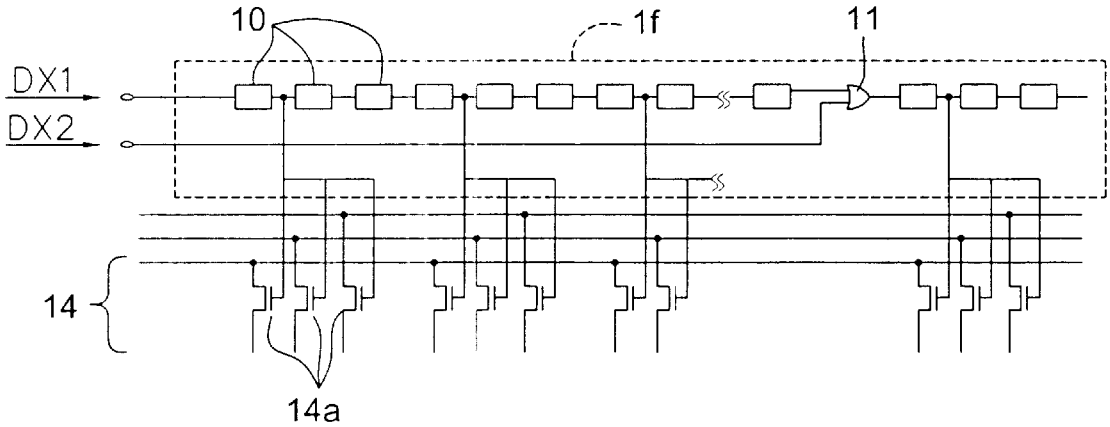
FIG. 19 is a schematic block diagram showing the X shift register adaptable to the embodiments and capable of outputting a transfer signal as a sampling circuit driving signal at intervals of a plurality of stages.

In the embodiments, a transfer signal output from each stage (each flip-flop) of the X shift register is output externally as a sampling circuit driving signal from the X shift register. As shown in FIG. 19, the X shift registers in the embodiments may be designed so that a transfer signal output at intervals of a plurality of stages can be output as a sampling circuit driving signal externally from an X shift register. In FIG. 19, three adjoining flip-flops 10 are designed so that every third flip-flop 10 will output a transfer signal from an X shift register if to the sampling circuit 14, and transfer signals output from other flip-flops 10 will not be output externally from the X shift register If but will be transferred to subsequent stages.

Embodiments of electronic equipment including any of the aforesaid liquid crystal devices will be described with reference to FIGS. 9 to 13.

Figure 20:
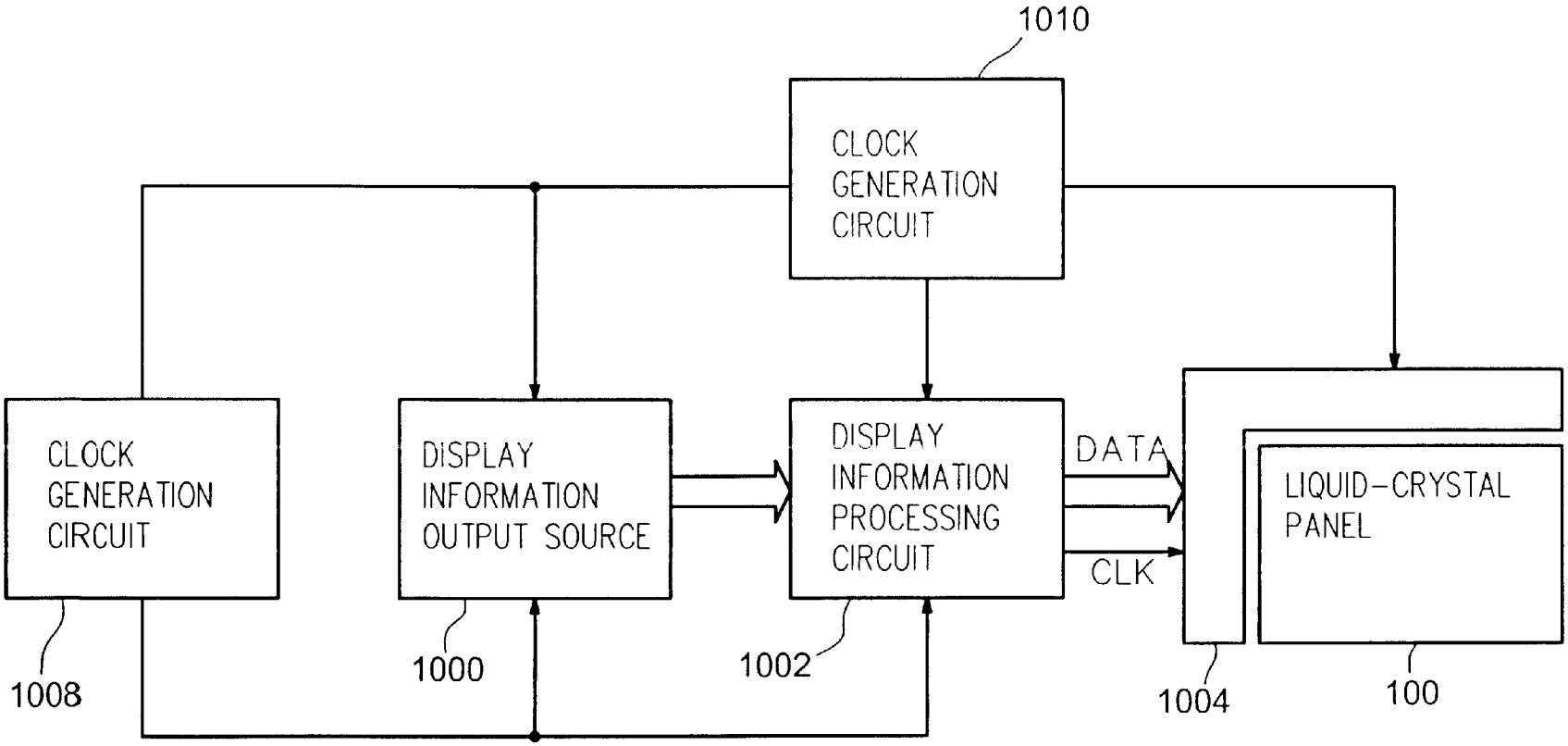
FIG. 20 is a block diagram showing the schematic configuration of an embodiment of the electronic equipment in accordance with the present invention.

FIG. 20 shows the schematic configuration of an embodiment of electronic equipment including any of the liquid-crystal devices of the first to sixth embodiments.

In FIG. 20, the electronic equipment comprises a display information output source 1000, a display information processing circuit 1002, a drive circuit 1004, a liquid crystal panel 100, a clock generation circuit 1008, and a power supply circuit 1010. The display information output source 1000 includes a memory such as a read-only memory (ROM), a random access memory (RAM), or an optical disk device, and a tuning circuit for tuning and outputting a TV signal. Based on a clock signal sent from the clock generation circuit 1008, the display information output source 1000 outputs display information such as an image signal of a given format to the display information processing circuit 1002. The display information processing circuit 1002 includes well-known processing circuits such as an amplification/polarity reversal circuit, a phase development circuit, a rotation circuit, a gamma correction circuit, and a clamping circuit. The display information processing circuit 1002 sequentially produces a digital signal using display information input synchronously with a clock signal and outputs the digital signal to the drive circuit 1004 together with the clock CLK. The drive circuit 1004 drives the liquid crystal panel 100. The power supply circuit 1010 supplies a given power to these circuits. The drive circuit 1004 may be mounted on a TFT array substrate included in the liquid crystal panel 100. In addition, the display information processing circuit 1002 may be mounted thereon.

FIGS. 21 to 24 show embodiments of electronic equipment each having the foregoing components.

Figure 21:
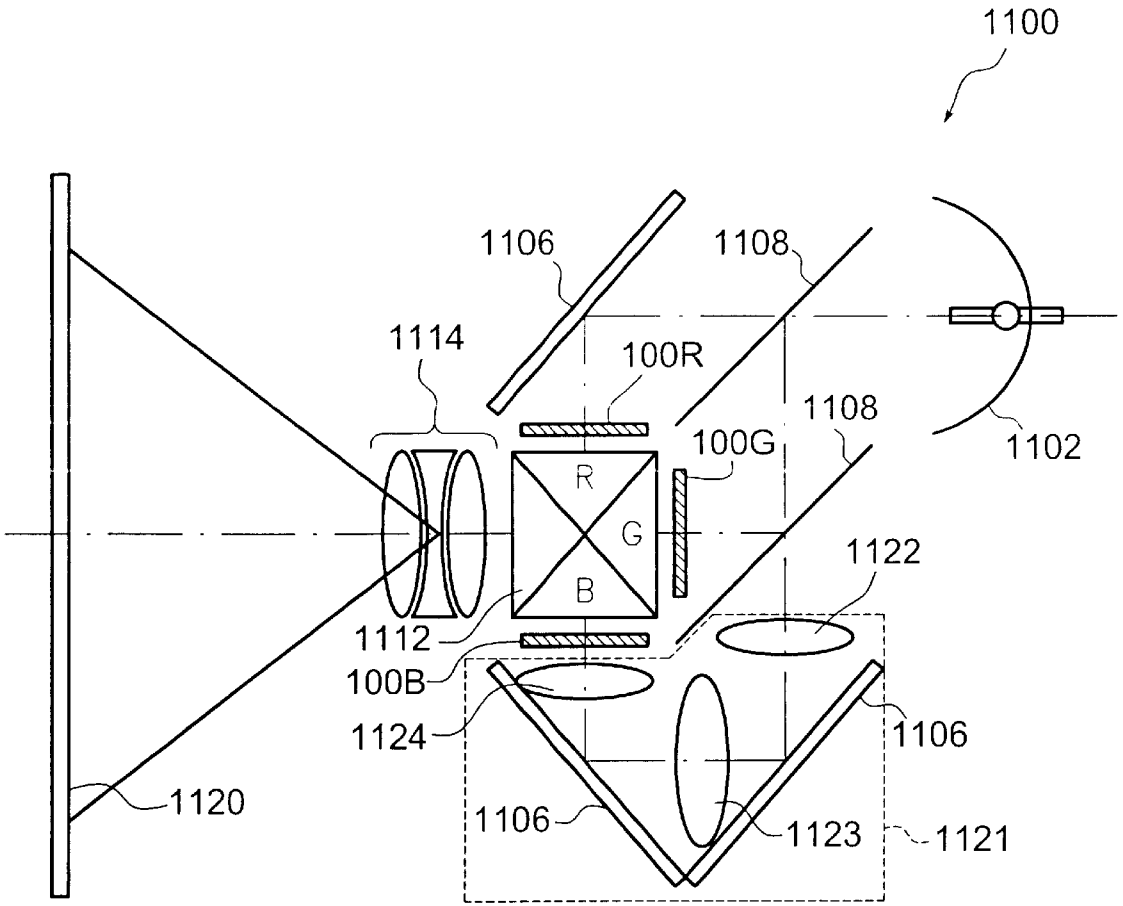
FIG. 21 is a sectional view showing a liquid-crystal projector as an example of an electronic equipment.

In FIG. 21, a liquid crystal projector 1100 that is an embodiment of electronic equipment has three liquid crystal modules, each including the liquid crystal panel 100, which has the drive circuit 1004 mounted on the TFT array substrate, as light valves 100R, 100G, and 100B for red light, green light, and blue light. In the liquid crystal projector 1100, when a lamp device 1102 that is a white light source such as a metal halide lamp emits projection light, the light is decomposed into red, green, and blue light components of three primary colors by means of three mirrors 1106 and two dichroic mirrors 1108, and routed to the light bulbs 100R, 100G, and 100B associated with the colors. Especially, blue light is routed by a system of relay lenses 1121 including an incident lens 1122, a relay lens 1123, and an emitting lens 1124 in order to suppress light loss stemming from a long optical path. The light components of the three primary colors modulated by the light bulbs 100R, 100G, and 100B are synthesized again by a dichroic prism 1112, and then projected as a color image on a screen 1120 via a projection lens 1114.

In this embodiment, especially, once a light shielding layer is formed under TFTs in pixels (through which projection light goes out), light can be fully intercepted from channels in the switching TFTs in the pixel electrodes, even if light reflected from the liquid crystal panel 100 proportionally to incident light by a projection optical system in the liquid crystal projector, light reflected from the surface of the TFT array substrate during propagation of incident light, or part of incident light transmitted by the dichroic prism 1112 after emitted from the other liquid crystal panel (parts of red light and green light) is incident as return light on the TFT array substrate. In this case, even when a prism contributing to a compact design is employed in the projection optical system, it is unnecessary to affix an anti-reflection (AR) film for preventing return light or coat a polarizer with an AR material between the TFT array substrate of each liquid crystal panel and the prism. This is quite helpful in realizing a compact and simple configuration.

Figure 22:
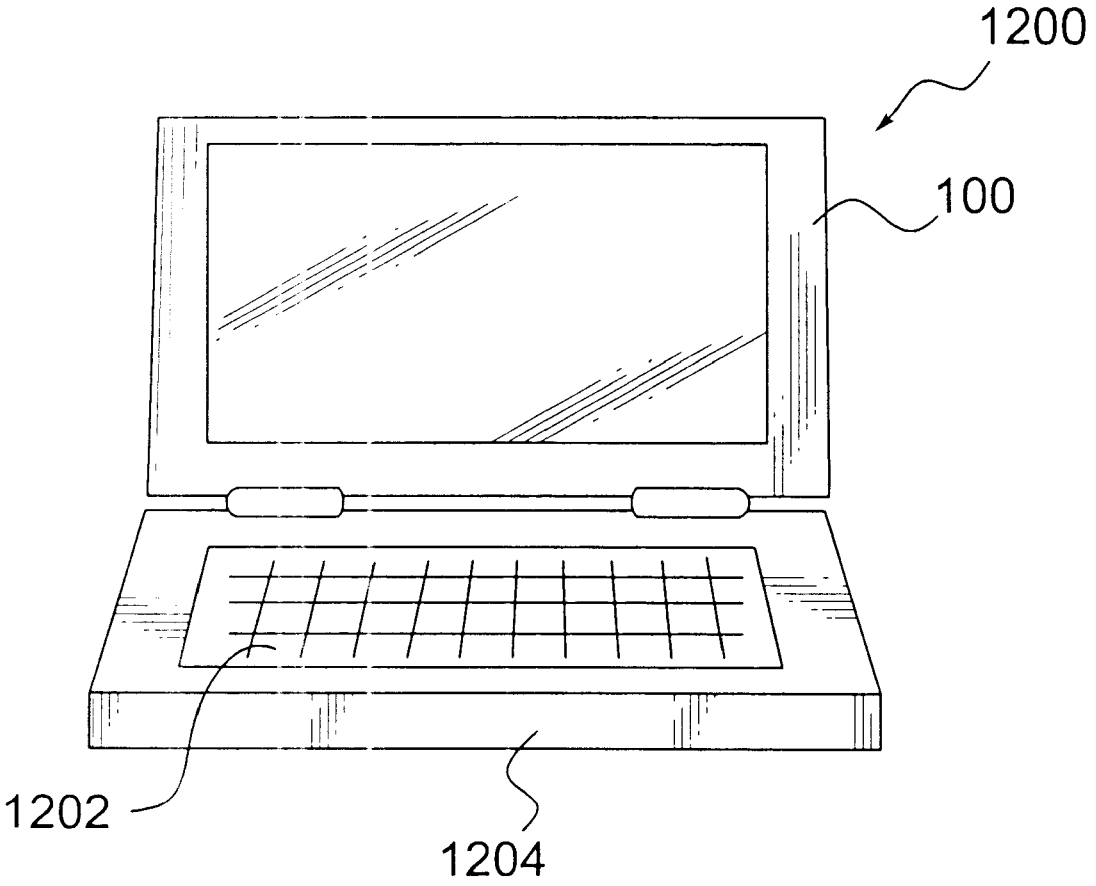
FIG. 22 is a front view showing a personal computer as another example of an electronic equipment.

In FIG. 22, a laptop type personal computer (PC) 1200 designed for multimedia, which is another embodiment of the electronic equipment, has the liquid crystal panel 100 encapsulated in a top-cover case, and further includes a body 1204 accommodating a CPU, memory, and modem and having a keyboard 1202 embedded therein.

Figure 23:
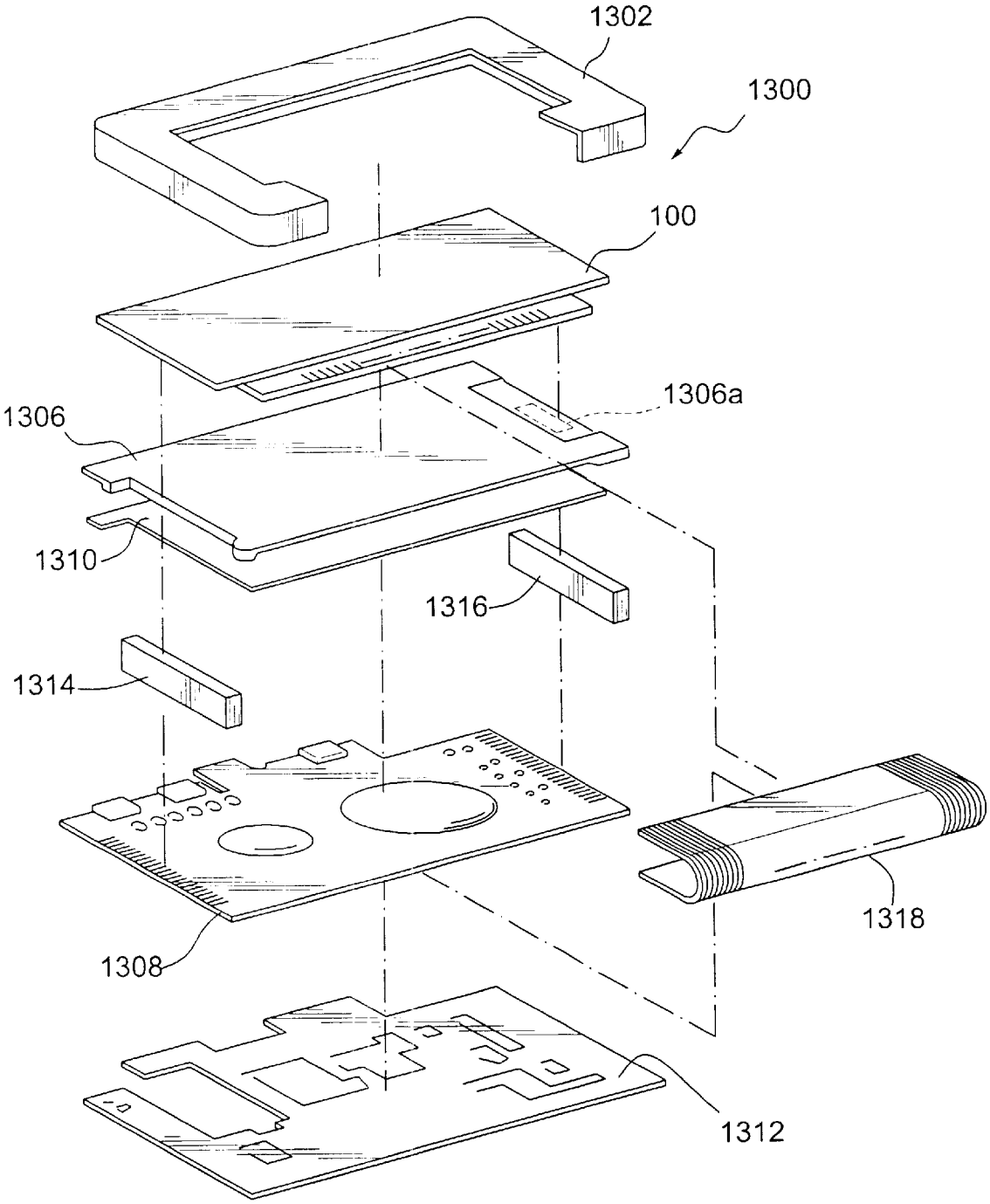
FIG. 23 is a disintegrated perspective view showing a pager as an example of the electronic equipment.

In FIG. 23, a pager 1300 that is another embodiment of the electronic equipment has a liquid crystal panel 100, which has the drive circuit 1004 mounted on the TFT array substrate as a liquid crystal module, incorporated in a metallic frame 1302 together with a light guide 1306 including a backlight 1306*a*, a printed-circuit board 1308, first and second shielding plates 1310 and 1312, two elastic conductors 1314 and 1316, and a film carrier tape 1318. In this case, the display information processing circuit 1002 (See FIG. 20) may be mounted on the printed-circuit board 1308 or on the TFT array substrate of the liquid crystal panel 100. Moreover, the drive circuit 1004 may be mounted on the printed-circuit board 1308.

Since the embodiment shown in FIG. 23 is a pager, the printed-circuit board 1308 is included. However, when the liquid crystal panel 100 is provided as a liquid crystal module including the drive circuit 1004 and display information processing circuit 1002, the liquid crystal panel 100 locked in the metallic frame 1302 may be produced, sold, or used as a liquid crystal device. Moreover, when the light guide 1306 is incorporated in the liquid crystal device, the liquid crystal device can be produced, sold, or used as a backlight liquid crystal device.

Figure 24:
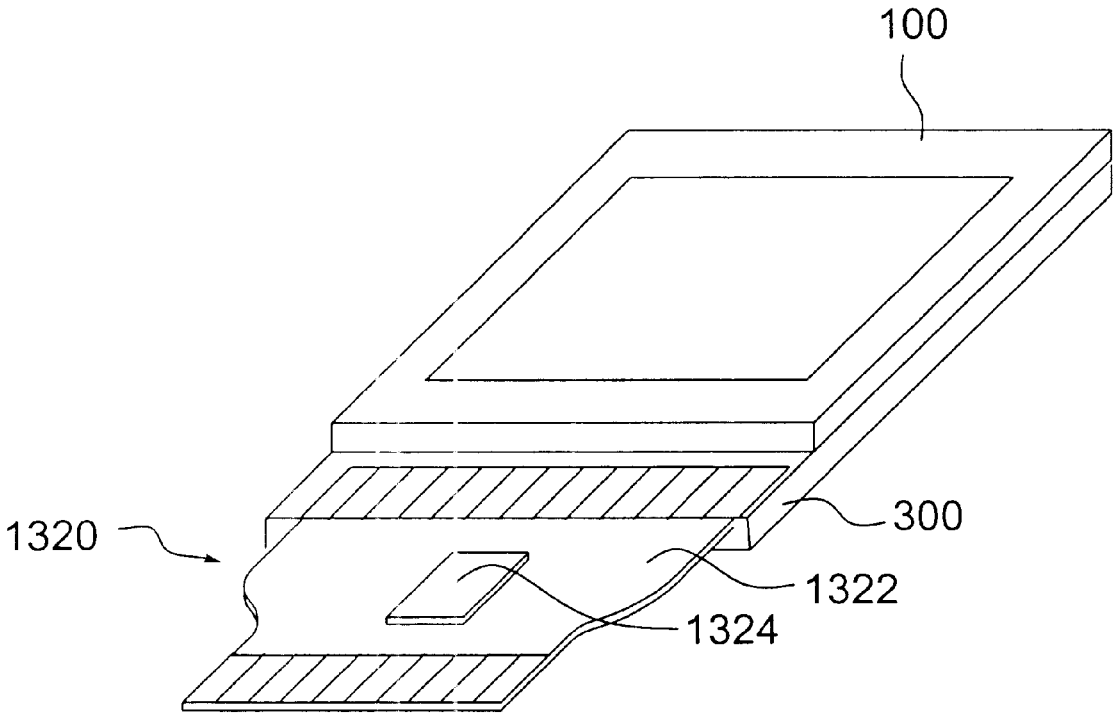
FIG. 24 is an oblique view showing a liquid crystal device using a TCP as an example of the electronic equipment.

As shown in FIG. 24, when the liquid crystal panel 100 includes neither the drive circuit 1004 nor display information processing circuit 1002, the liquid crystal panel 100 may be physically and electrically connected to a tape carrier package (TCP) 1320, which has an IC 1324 including the drive circuit 1004 and display information processing circuit 1002 mounted on a polyimide tape 1322, via an anisotropic conductive film attached to the margin of the TFT array substrate 300, and thus can be produced, sold, or used as a liquid crystal device.

Aside from the electronic equipment described with reference to FIGS. 21 to 24, a liquid crystal television set, a viewfinder type or direct monitor viewing type video tape recorder, a car navigation system, an electronic pocketbook, a tabletop calculator, a word processor, an engineering workstation (EWS), a portable telephone, a TV telephone, a POS terminal, and a device having a touch-sensitive panel are presented as examples of the electronic equipment shown in FIG. 20.

As described so far, according to this embodiment, various kinds of electronic equipment each including a liquid crystal device capable of properly blackening non-image display areas using a relatively simple configuration and displaying images of various aspect ratios.

According to the present invention, a driver of a liquid crystal panel is adaptable to a driver for driving a liquid crystal panel with an active matrix driving method such as TFT driving or MIM driving, and also usable for various types of scanners for selecting and scanning any of a plurality of kinds of areas to be scanned, of which widths to be scanned are mutually different, using a transfer signal sent from a shift register. Moreover, the driver of a liquid crystal panel can be employed in various types of liquid crystal devices or electronic equipment each including a driver of a liquid crystal panel as well as various types of electronic equipment including various types of scanners.

What is claimed is:

1. A driver for driving a liquid crystal panel having a plurality of signal lines which are arranged in a first direction and to which an image signal is supplied, a plurality of scanning lines which are arranged in a second direction orthogonal to said first direction and to which a scan signal is supplied sequentially, and a plurality of pixels arranged in the form of a matrix and driven with said image signal and said scan signal supplied by said plurality of signal lines and said plurality of scanning lines. respectively, said driver comprising:

an image signal supply unit including a first-direction shift register having a plurality of stages, and supplying the image signal sequentially to said plurality of signal lines in the first direction according to a transfer signal sequentially generated by said first-direction shift register;

a scan signal supply unit including a second-direction shift register having a plurality of stages, and supplying the scan signal sequentially to said plurality of scanning lines in the second direction according to a transfer signal sequentially generated by said second-direction shift register;

at least one of said first-direction and second-direction shift registers comprising a transfer start control unit that selectively allows at least two predetermined stages among said plurality of stages to start generating the transfer signal, the at least one of said first-direction and second-direction shift registers comprising a detector that detects termination of a scan effected with the transfer signal on a given stage; and a voltage application device that applies a given voltage to pixels constituting non-image display areas that are outside an image display area, the image display area being defined by the image signal at a synchronous time when termination of the scan is detected.

2. The driver according to claim 1, wherein said voltage application device reverses a polarity of said given voltage applied to the liquid crystal according to the image signal at intervals of a given period.

3. A liquid crystal device including a driver for driving a liquid crystal panel, and a liquid crystal panel having a pair of substrates, the liquid crystal sandwiched between said substrates, a plurality of signal lines which are arranged in a first direction on the substrate and to which an image signal is supplied, a plurality of scanning lines which are arranged in a second direction orthogonal to said first direction on the substrate and to which a scan signal is supplied sequentially, and a plurality of pixels arranged in the form of a matrix and driven with said image signal and said scan signal supplied by said plurality of signal lines and said plurality of scanning lines. respectively, said driver comprising:

an image signal supply unit including a first-direction shift register having a plurality of stages, and supplying the image signal sequentially to said plurality of signal lines in the first direction according to a transfer signal sequentially generated by said first-direction shift register;

a scan signal supply unit including a second-direction shift register having a plurality of stages, and supplying the scan signal sequentially to said plurality of scanning lines in the second direction according to a transfer signal sequentially generated by said second-direction shift register;

at least one of said first-direction and second-direction shift registers comprising a transfer start control unit that selectively allows at least two predetermined stages among said plurality of stages to start generating the transfer signal, the at least one of said first-direction and second-direction shift registers comprising a detector that detects the termination of a scan effected with the transfer signal on a given stage; and a voltage application device that applies a given voltage to pixels constituting non-image display areas that are outside an image display area, the image display area being defined by the image signal at a synchronous time when termination of the scan is detected.

4. The liquid crystal device according to claim 3, wherein said voltage application device reverses a polarity of said given voltage applied to the liquid crystal according to the image signal at intervals of a given period.

5. An electronic equipment including a liquid crystal device, the liquid crystal device including a driver for driving a liquid crystal, and a liquid crystal panel having a pair of substrates, the liquid crystal sandwiched between said substrates, a plurality of signal lines which are arranged in a first direction on the substrate and to which an image signal is supplied, a plurality of scanning lines which are arranged in a second direction orthogonal to said first direction on the substrate and to which a scan signal is supplied sequentially, and a plurality of pixels arranged in the form of a matrix and driven with said image signal and said scan signal supplied by said plurality of signal lines and said plurality of scanning lines, respectively said driver comprising:

an image signal supply unit including a first-direction shift register having a plurality of stages, and supplying the image signal sequentially to said plurality of signal lines in the first direction according to a transfer signal sequentially generated by said first-direction shift register;

a scan signal supply unit including a second-direction shift register having a plurality of stages, and supplying the scan signal sequentially to said plurality of scanning lines in the second direction according to a transfer signal sequentially generated by said second-direction shift register;

at least one of said first-direction and second-direction shift registers comprising a transfer start control unit that selectively allows at least two predetermined stages among said plurality of stages to start generating the transfer signal, the at least one of said first-direction and second-direction shift registers comprising a detector that detects the termination of a scan effected with the transfer signal on a given stage; and a voltage application device that applies a given voltage to pixels constituting non-image display areas that are outside an image display area, the image display area being defined by the image signal at a synchronous time when termination of the scan is detected.

6. The electronic equipment according to claim 5, wherein said voltage application device reverses a polarity of said given voltage applied to the liquid crystal according to the image signal at intervals of a given period.

* * * * *